US009386866B2

(12) United States Patent
Presenty

(10) Patent No.: US 9,386,866 B2
(45) Date of Patent: Jul. 12, 2016

(54) CONTAINER ORGANIZING APPARATUS AND SYSTEM

(76) Inventor: Tal Presenty, Tel Mond (IL)

( * ) Notice: Subject to any disclaimer, the term of this patent is extended or adjusted under 35 U.S.C. 154(b) by 79 days.

(21) Appl. No.: 14/241,636

(22) PCT Filed: Aug. 30, 2012

(86) PCT No.: PCT/IL2012/000325

§ 371 (c)(1),
(2), (4) Date: Feb. 27, 2014

(87) PCT Pub. No.: WO2013/030826

PCT Pub. Date: Mar. 7, 2013

(65) Prior Publication Data

US 2014/0360955 A1 Dec. 11, 2014

Related U.S. Application Data

(60) Provisional application No. 61/530,151, filed on Sep. 1, 2011.

(51) Int. Cl.

| | |
|---|---|
| ***A47B 73/00*** | (2006.01) |
| ***A47F 5/00*** | (2006.01) |
| ***A47B 96/14*** | (2006.01) |
| ***A47F 5/08*** | (2006.01) |

(52) U.S. Cl.

CPC ..... *A47F 5/0037* (2013.01); *A47B 96/1466* (2013.01); *A47F 5/0846* (2013.01); *A47B 73/00* (2013.01)

(58) Field of Classification Search

CPC . A47F 5/0037; A47F 5/0846; A47B 96/1466; A47B 73/003

USPC ..... 211/86.01, 94.01, 87.01, 106.01, 57.1, 211/54.1; 248/225.11, 220.21, 220.22, 248/223.41, 224.51, 224.61; 220/480, 481, 220/478

See application file for complete search history.

(56) References Cited

U.S. PATENT DOCUMENTS

| | | | | | |
|---|---|---|---|---|---|
| 163,531 | A | * | 5/1875 | Roake | F16L 3/04 248/224.61 |
| 512,261 | A | * | 1/1894 | Nailor | B65F 1/02 220/254.3 |
| 699,906 | A | * | 5/1902 | Williams | B60P 3/00 220/480 |
| 1,226,101 | A | * | 5/1917 | Marsden | A47G 7/044 211/85.18 |

(Continued)

FOREIGN PATENT DOCUMENTS

| | | |
|---|---|---|
| FR | 2 888 795 | 1/2007 |
| GB | 2 397 215 | 7/2004 |

OTHER PUBLICATIONS

Supplementary EPO Search Report for Application No. EP 12 82 7735, Mar. 31, 2015.

(Continued)

*Primary Examiner* — Joshua J Michener
*Assistant Examiner* — Devin Barnett
(74) *Attorney, Agent, or Firm* — The Law Office of Joseph L. Felber

(57) ABSTRACT

The present invention relates to system and apparatus for tool and container organization and in particular to such an organization apparatus where a container holding assembly may be placed at various optional positions relative to a mounting surface providing while providing for comfortable storage or access to container contents at any optional position.

18 Claims, 19 Drawing Sheets

(56) References Cited

U.S. PATENT DOCUMENTS 1,594,535 A * 8/1926 Lindbeck ..... A47J 47/02 119/71
1,728,512 A 9/1929 Sharp
1,906,220 A 5/1933 Allan
2,277,738 A * 3/1942 Wilkinson ..... B01D 27/00 210/249
2,427,335 A * 9/1947 Antonia ..... A47J 47/16 220/478
2,639,055 A * 5/1953 Carlson ..... B60N 3/083 131/235.1
2,926,879 A * 3/1960 Dietrich ..... A47G 23/0225 224/406
3,131,251 A * 4/1964 Ryan ..... B60R 1/04 248/224.51
3,212,660 A * 10/1965 Adell ..... B60S 1/50 215/383
3,670,530 A * 6/1972 Filipak ..... D06F 39/024 220/478
3,679,087 A * 7/1972 Poli ..... B65D 83/00 220/478
3,734,439 A * 5/1973 Wintz ..... A47G 23/0241 131/241
3,840,204 A * 10/1974 Thomas ..... B63B 29/12 131/241
3,842,981 A * 10/1974 Lambert ..... A47G 29/08 211/74
4,064,992 A 12/1977 Ralston et al.
D253,629 S * 12/1979 Sage ..... D7/621
4,191,350 A * 3/1980 Ormond ..... A01K 97/04 248/292.13
4,450,975 A * 5/1984 Glass ..... A24F 19/0092 131/257
4,531,331 A * 7/1985 Itagaki ..... A47F 5/0846 211/189
4,572,381 A * 2/1986 Breakey ..... A47F 5/0846 211/94.01
4,629,076 A * 12/1986 Amstutz ..... A47F 5/0846 156/64
4,678,151 A * 7/1987 Radek ..... A47F 5/0846 211/59.1
4,694,965 A * 9/1987 Parnell ..... A47F 5/0846 211/189
D309,848 S * 8/1990 Sokolski ..... D7/620
5,056,696 A * 10/1991 Lahr ..... A45F 5/02 224/148.4
5,356,105 A * 10/1994 Andrews ..... B63B 35/14 248/221.11
5,489,055 A * 2/1996 Levy ..... B60N 3/103 224/544
5,512,912 A * 4/1996 Ross ..... H01Q 1/18 343/709
5,988,410 A 11/1999 Mandle
6,481,679 B1 * 11/2002 Bennett ..... A61G 13/101 248/223.41
6,547,086 B1 * 4/2003 Harvey ..... A47F 5/0846 211/87.01
6,763,957 B1 * 7/2004 Mullerleile ..... A47F 5/0846 211/59.1
6,908,163 B1 6/2005 Hebeler et al.
7,261,264 B2 * 8/2007 Moran ..... A01K 1/0356 24/573.11
7,270,309 B2 * 9/2007 Burns ..... F16M 13/02 211/162
7,434,686 B2 * 10/2008 Prindle ..... A61M 5/002 206/364
7,485,830 B2 * 2/2009 Wang ..... F24C 1/00 219/201
7,926,771 B2 * 4/2011 DeMartine ..... F16M 11/10 248/218.4
7,959,121 B1 * 6/2011 Barnes, Jr. ..... A47G 23/0225 224/148.4
8,070,118 B1 * 12/2011 Collins ..... A47F 5/0846 211/88.01
8,157,228 B2 * 4/2012 Smith ..... E04F 21/1855 248/222.14
8,505,728 B2 * 8/2013 Su ..... B25H 3/022 206/486
9,072,637 B1 * 7/2015 Puri ..... A61G 7/0503
2004/0031890 A1 * 2/2004 Haluzak ..... A47F 5/0846 248/220.31
2008/0302744 A1 * 12/2008 Rosenberg ..... A47F 5/0025 211/94.01
2009/0134290 A1 * 5/2009 Begic ..... F16M 13/02 248/222.13
2010/0108838 A1 * 5/2010 DeMartine ..... F16M 11/10 248/222.14
2014/0271098 A1 * 9/2014 Muderlak ..... B65F 1/068 414/808
2015/0001359 A1 * 1/2015 Catchings ..... A61G 5/00 248/220.22
2015/0282345 A1 * 10/2015 Aspinall ..... H04M 1/02 248/220.22

OTHER PUBLICATIONS

International Search Report for application PCT/IL2012/000325.

* cited by examiner

101

102

104

CONTAINER ORGANIZING APPARATUS AND SYSTEM

This Application is a national phase of, and claims priority from, PCT Application No. PCT/IL 2012/000325, filed on Aug. 30, 2012, which claims priority from U.S. Provisional Application No. 61/530,151, filed Sep. 1, 2011, which is hereby incorporated by reference as if fully set forth herein.

FIELD OF THE INVENTION

The present invention relates to system and apparatus for tool and container organization and in particular to such an organization apparatus where a container holding assembly may be placed at various optional positions relative to a mounting surface providing while providing for comfortable storage or access to container contents at any optional position.

BACKGROUND OF THE INVENTION

Storage devices have utility both in the home and work environments. Storage devices using container are commonly used for organizing and storing various articles of varying sizes. Many example of such a storage organizing racks for tools, part, jewelry and perishable foods such as spices may be found in the prior art. Many such organization systems are wall mountable containing storage bins, for example, U.S. Pat. No. 4,378,889 to Lebowitz describes a stepwise spice rack for holding bottles containing spices.

Other storage systems offer portable apparatus, such as the described in U.S. Pat. No. 5,460,277 to Silva. While others describe portable and wall mountable tool boxes for example that described in US Publication No. Patent No. 20080169739 to Goldberg. Similarly, U.S. Pat. No. 6,113,202 to Germano discloses a portable, wall mountable tool box supply cabinet and work bench combination.

Prior art organizing containers, tilt bins, apparatus and system, for example as shown in FIG. 1A. Such tilt bins are limited in that they do not allow for tilting or positioning a container while maintain the container in a closed formation. Rather, prior art tilt bins and similar organization systems, such as drawers, are without a lid and therefore in the open formation when drawn or tilted allowing access to the container's content. Therefore state of the art container and bins organization system are limited in that access to the container contents are limited only to when the container is drawn out, tilted or otherwise opened. Furthermore secured storage (contents within container, closed with a lid) is only possible when the bins/containers are in the upright position (not tilted) or not-drawn.

SUMMARY OF THE INVENTION

The present invention overcomes these deficiencies of the background art by providing a container organizing apparatus and system. Optionally and preferably, the apparatus and system according to the present invention provides for organizing tools and container for example including but not limited to containers, bins and/or bottles. The present invention overcomes the prior art in that the container and contents may be stored (closed formation, with a closed lid) or accessed (open formation, with an open lid) in at least two position comprising an upright position and at least one or more tilted or angled positions.

Within the context of this application the term container is used to refer to any type of a container, storage container, bin, bottle or the like storage device. An exemplary container is depicted in FIGS. 1B-D. Optionally, the container may be provided in a plurality of shapes for example including but not limited to circular, cylindrical, elliptical, square, rectangular, hexagon, octagon, pentagon or the like geometric shape. Optionally, the container may be provided with or without lid. Optionally, if provided with a lid the lid may be detachable as exemplified in FIG. 1D or may be integrated in a plurality of optional formations for example as exemplified in FIG. 1B comprising an internal hinge or as exemplified in FIG. 1C with an external and/or built in hinge (not shown). Optionally and preferably the container holding apparatus according to optional embodiments of the present invention facilitates opening and closing a container, for example FIG. 1B-D, with one hand.

Within the context of this application the term clasp and/or holder is to refer to a fastener that firmly holds a container in place. The term clasp may optionally be interchangeably be used with the term container clasp, holder, fastener, hook, clamp, clip or grip. Optionally and preferably, the term clasp is to refer to a device adept to receive and firmly hold a container. Most preferably, a clasp is shaped to receive a container that is shaped accordingly. For example a circular or elliptical container may be received by a circular shaped clasp. For example, a square shaped clasp is intended to receive a square shaped container.

Most preferably, a clasp/holder comprises an anterior opening defined by at least two flanking arms on either side of the opening and that are joined posterior to the opening provided to receive a storage container. Most preferably, the shape of the flanking arms may vary and is provided to correspond to the shape of the container being received the opening. Optionally at least two flanking arms may be positioned relative to the container for example including but not limited to vertically, horizontally, angular or the like. Optionally the at least two flanking arms may be positioned on opposite sides relative to the container. Optionally, the at least two flanking arms may be position on the right and left sides of the container. Optionally, the at least two flanking arms may be position on the top and bottom sides of the container. Optionally a plurality of flanking arms may be utilized to hold the container in a vertical, horizontal, or angular position relative to the container or in a combination thereof. Optionally a plurality of flanking arms to may be used on at least one or more flanking side for example including but not limited to top, bottom, left, right, vertical, horizontal or a combination thereof.

Within the context of this application the term backing and/or clasp rack may be interchangeably used with the terms rack, support, holder, bracket, panel, board or the like. Most preferably within the context of this application a rack refers to a backing that comprises at least one or more preferably a plurality of clasps. Optionally, a clasp/holder may be integrated with a rack along the anterior surface of the clasp. Optionally, a clasp may be associated with a backing/rack by a mediating member. Optionally a mediating member may be stationary or non-stationary. Optionally a non-stationary mediating member may provide for angular, rotational, forward, backward or the like movement.

A first preferred embodiment of the present invention provides for a horizontal clasp rack comprising at least one or more clasps along its length for receiving and holding at least one or more containers, and wherein the clasp rack comprises at least one connector. Optionally the clasp rack connector is disposed along midpoint of the clasp rack length. Optionally and preferably, at least two connectors are disposed on ether right and left ends of the rack length. Most preferably a plurality of connectors are distributed along the length of the rack. Optionally, the plurality of connectors may be distributed in an evenly spaced manner, or pattern, optionally the connector spacing may be provided in an regular or irregular pattern along the length of horizontal clamp rack.

Optionally and preferably, at least one or more clasps may be integrated with the clasp rack forming a unified continuous structure. Optionally at least one or more clasps may be associated with the clasp rack via a mediating member. Optionally the mediating member may form an angle between the clasp rack and the clasp. Optionally, the angle formed by the mediating member may be provided in at least one or more preset angles, for example including but not limited to 45 degrees, 30 degrees, 60 degrees, or 90 degrees. Most preferably, the mediating member may be adjusted to toggle between the present angles. Optionally and preferably the angle may be variably set to including angles from about 0 degrees up to about 180 degrees. Optionally and preferably the mediating member comprises a first surface associated with the clasp rack and a second surface associated with the clasp wherein the angle is formed between the first and second surface of the mediating member. Most preferably, the first and second surfaces are mediated by hinge for controlling and or varying the angle therebetween for example including but not limited to a hinge, latch, a stepwise hinge, gear hinge, ratchet, stepwise latch, click lever or the like.

A second embodiment of the present invention comprises an apparatus and system comprising at least one rail for receiving and holding at least one and more preferably a plurality of clasp racks according to the present invention. Most preferably the second embodiment of the preferred embodiment of the present invention comprises at least two rails wherein each rail is associated with one end of a clasp rack. Most preferably a rail according to the present invention comprises at least one mounting socket optionally and preferably for wall mounting. Optionally and preferably, the wall mounting socket is disposed on the upper portion of rail, most preferably the wall mounting socket is disposed along the upper end of the rail. Optionally, the rail may be provided in a horizontal orientation.

Most preferably the rail according to the present invention comprises a plurality of clasp rack slots disposed along its length wherein each slot is adept for receiving the clasp rack connector according to the present invention. Optionally, the rack and rail are connected by applying pressure wherein the male connectors optionally and preferably disposed on at the end of clasp rack are firmly pushed to engage and fit over the receiving female slots provided along the length of the rail slots. Optionally, the clasp rack may be provided with male connectors that are disposed over while the female connectors are disposed over the rail. Optionally, the clasp rack may be provided with female connectors while the rail may be provided with male connectors.

Most preferably, a plurality of rails and racks may be associated with one another to form a modular system adept to fit the organizing system according to the present invention over any surface most preferably to optimize the space utilization A third preferred embodiment of the present invention comprises a frame structure optionally and preferably in a quadrilateral formation for example a square or rectangle, diamond shape or the like. Optionally the frame comprising at least one frame connector slot along at least one or more frame edge. Optionally and preferably at least two frame edges comprise at least one frame connector slot. Preferably at least one frame edge comprises at least two frame connector slots. Most preferably, all frame edges comprises at least two frame connector slots. Optionally, at least one connector slot is disposed along at least one frame edge. Optionally, at least one connector slot is disposed at one end of at least one frame edge. Most preferably at least two frame connector slots are disposed at either end of at least one frame edge. Optionally and preferably, the frame connector slots disposed along the edge of the frame provide for coupling adjacent frames to one another.

Optionally and preferably, the frame further comprises at least one and more preferably a plurality of vertical support structure spanning the length of the frame. Optionally, a plurality of vertical support structures is distributed between the right and left edges of the frame, most preferably, vertical support structures are distributed evenly.

Most preferably, the frame further comprises at least one and more preferably a plurality of horizontal support structures for accepting the clasp rack according to the first embodiment of the present invention. Most preferably horizontal support structure is disposed on one face of the frame. Optionally, the horizontal support structures may be provided on both faces of the frame according to the present invention therein providing for an additional storage plane. Optionally, the horizontal support structure comprises at least one rack connector slot, optionally and preferably the horizontal support structures comprises at least one pair of rack connector slots and most preferably the horizontal support structures comprise a plurality of rack connector slot pairs for associating with the clasp rack.

A fourth optional embodiment of the present invention provides for a mobile organization system wherein a case comprising a carrying handle may be provided with at least one or more frames according to the third embodiment of the present invention. Optionally, a case according to the present invention for an organization system may be provided with at least 2 or more frames according to the third embodiment of the present invention. Optionally the case may be further provided with at least one and more preferably a plurality of mounting sockets for optionally mounting on a vertical surface for example a wall. Optionally, the case according to the present invention may be provided in the form of a briefcase or the like as is known in the art.

Optionally the carrying case according to the fourth embodiment of the present invention may be provided with at least one or more rails according to the second embodiment of the present invention as described above. Optionally the case according to the fourth embodiment of the present invention may be provided with at least two and more preferably a plurality of rails according to the second embodiment of the present invention as described above.

Optionally the carrying case according to the fourth embodiment may be provided with at least one or more opening to gain access to the storage compartments associated with the rail and or frame according to the present invention. Optionally any of the case may be provided with a midline opening for example a briefcase or suitcase. Optionally, any of the sides of the carrying case may be provided with an opening face to gain access to the storage compartment. Optionally, at least one or more storage frames or rails may be accessed from the opening once opened.

A fifth embodiment according to the present invention comprises a stand comprising at least one frames according to the third embodiment of the present invention that is further comprising a base coupled to the lower surface of the frame, most preferably over at least two frame connector slots. Optionally, the base may be adapted to receive up to two frames disposed back to back along the frame. Optionally, a single frame may be adapted to provide two storage surfaces along each of the frame surfaces as described above.

A sixth optional embodiment according to the present invention comprises a clamp rack according to the first embodiment of the present invention for storing a plurality of containers and/or tools that is adapted to be stacked onto a base and supported by at least one or more vertical support members, optionally and preferably support may be provided with at least two vertical support members. Optionally a plurality of clamp racks may be stacked one on top of the other each stack mediated by at least one or more vertical support member. Most preferably, each vertical support member is coupled to at least one connector disposed on the clamp rack according to the present invention.

Preferably the system according the present invention comprises at least one frame and/or rail support storage comprising at least one clasp rack preferably adept for storing at least one or more storage containers as described above.

Optionally, the organizing apparatus and system according to any one of the preceding embodiments of the present invention may be provided and/or manufactured and/or composed in whole or in part of synthetic for example including but not limited to plastic and/or natural materials for example including but not limited to wood and/or metal.

Optionally, the organizing apparatus and system according to any one of the preceding embodiments of the present invention may be provided and/or manufactured or provided in whole or in part of plastic materials optionally including but not limited to PVC, nylon, polypropylene, polyethylene, acrylic, plastic having a glass fiber additive, or the like.

Optionally, the organizing apparatus and system according to any one of the preceding embodiments of the present invention may be provided and/or manufactured and/or composed in whole or in part of metal or metallic alloys or the like as is known and accepted in the art.

Optionally, the organizing apparatus and system according to any one of the preceding embodiments of the present invention may be provided and/or manufactured and/or composed in whole or in part of wood, wood composites, or the like natural product as is known and accepted in the art.

Optionally, the modular organizing apparatus and system according to any one of the preceding embodiments of the present invention may be provided and/or manufactured and/or composed in whole or in part or in relative percentages of at least two or more natural materials and synthetic materials.

An optional and preferred embodiment of the present invention provides a container holding assembly characterized in that the assembly provides for positioning the a container and toggling between at least two positions relative to a mounting surface, the container assembly comprising:

a) at least one container holder for holding the container, the holder having at least two extension defining an anterior opening for receiving the container;

b) the container holder comprising a backing member wherein the backing member comprises a positioning recess provided for positing the assembly relative to the mounting surface about the at least two positions; and c) a mediating member associated with the holder about the backing member, wherein the mediating member may be provided for mounting the holder onto the mounting surface or a mounting member; and wherein the holding assembly may be characterized in that the containers may be placed in an open or closed formation in either of the at least two positions relative to a mounting surface.

Optionally the positioning recess may be a bifurcated recess having at least three stop positions wherein each pair of stop positions corresponds to a container position relative to the mounting surface.

Optionally at least one peg may be configured to associate within the positioning recess to determine the position of the assembly relative to the mounting surface.

Optionally at least two positions relative to a mounting surface may be selected from the group consisting of substantially parallel to the mounting surface, about 45 degrees, about 30 degrees, about 60 degrees, up to 180 degrees and any combination thereof.

Optionally and preferably the at least two positions relative to a mounting surface includes: a) a first position forming an upright position that is substantially parallel to the mounting surface; and b) a second position tilted or angled position relative to the mounting surface selected from the group consisting about 45 degrees, about 30 degrees, about 60 degrees, up to 180 degrees and any combination thereof.

Optionally the holder extensions are selected from the group consisting of two flanking arms or two vertical holders, any combination thereof.

Optionally the holder extensions include two flanking arms and a lower surface retainer.

Optionally the mediating member may be configured to receive two holders.

Optionally the mediating member comprises at least two connectors for coupling with the mounting member.

Optionally the mediating member may be configured to receive a single holder.

Optionally at least one peg may be disposed about the mediating member or the backing member.

Optionally the container may be selected from the group consisting of a jar, jar with an integrated lid, container with an integrated hinged lid, open container, container with a seal.

An optional embodiment of the present invention provides a container organization system comprising the container holding assembly according to an optional embodiment of the present invention and a mounting member wherein the mounting member provides for mounting the holding assembly about a mounting surface; and wherein the mediating member facilitates mounting the container holding assembly about the mounting member.

Optionally the mounting member may be coupled to a mounting surface selected from the group consisting of a vertical surface, a wall, a base, a internal lumen of a carrying case, tool case, tool bucket, tool box.

Optionally at least two or more mounting members may be coupled with one another.

Optionally the mounting member may be coupled via a coupling member.

Optionally the mounting member may be a mounting panel including a panel rail provided for receiving and interfacing with a mediating member of holder assembly.

Optionally the mounting panel may be coupled with up to two mounting panels, wherein adjacent mounting panels are coupled about upper surface comprising a female coupling member and lower surface comprising a male coupling member.

Optionally the mounting member may be a mounting frame comprises a plurality of horizontal supports for accepting a mediating member about at least one face of the frame mounting member.

Optionally the frame mounting unit comprises a plurality of horizontal supports for accepting a mediating member about both faces of the frame mounting member.

Optionally the frame mounting unit comprises at least one connector slot for coupling adjacent frame mounting units with a coupler.

Optionally the connect slots are disposed about a vertical support structure defined about same frame mounting unit.

Optionally the mounting surface may be a mobile carrier in the form of a closed case in the form of a briefcase with at least one opening for gaining access to the modular mounting unit.

Optionally the mobile carrier comprises at least two openings to gain access to its mounting surface.

Optionally the mobile container carrier further comprises at least two mounting sockets.

Optionally the container organization system may be provided in the form of a tool bucket having a carrying handle. Optionally the tool bucket may comprise at least one holding assembly, according to optional embodiments of the present invention. Optionally, the at least one holding assembly may be disposed about an external surface of the tool bucket. Optionally the at least one holding assembly may be configured to protrude from the external surface or disposed about an indentation about at least one external surface. Optionally, the external surface further comprises at least one or more tool rack. Optionally the tool rack may be configured to associated and/or disassociate from the external surface.

Unless otherwise defined, all technical and scientific terms used herein have the same meaning as commonly understood by one of ordinary skill in the art to which this invention belongs. The materials, methods, and examples provided herein are illustrative only and not intended to be limiting.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 17A-B show the container holding member in an upright position; FIG. 17C-D show the container holding assembly in an angled position;

FIG. 6A provides a side view, FIG. 6B shows a perspective posterior view;

DESCRIPTION OF THE PREFERRED EMBODIMENTS

Figures 1A, 1B, 1C, 1D:
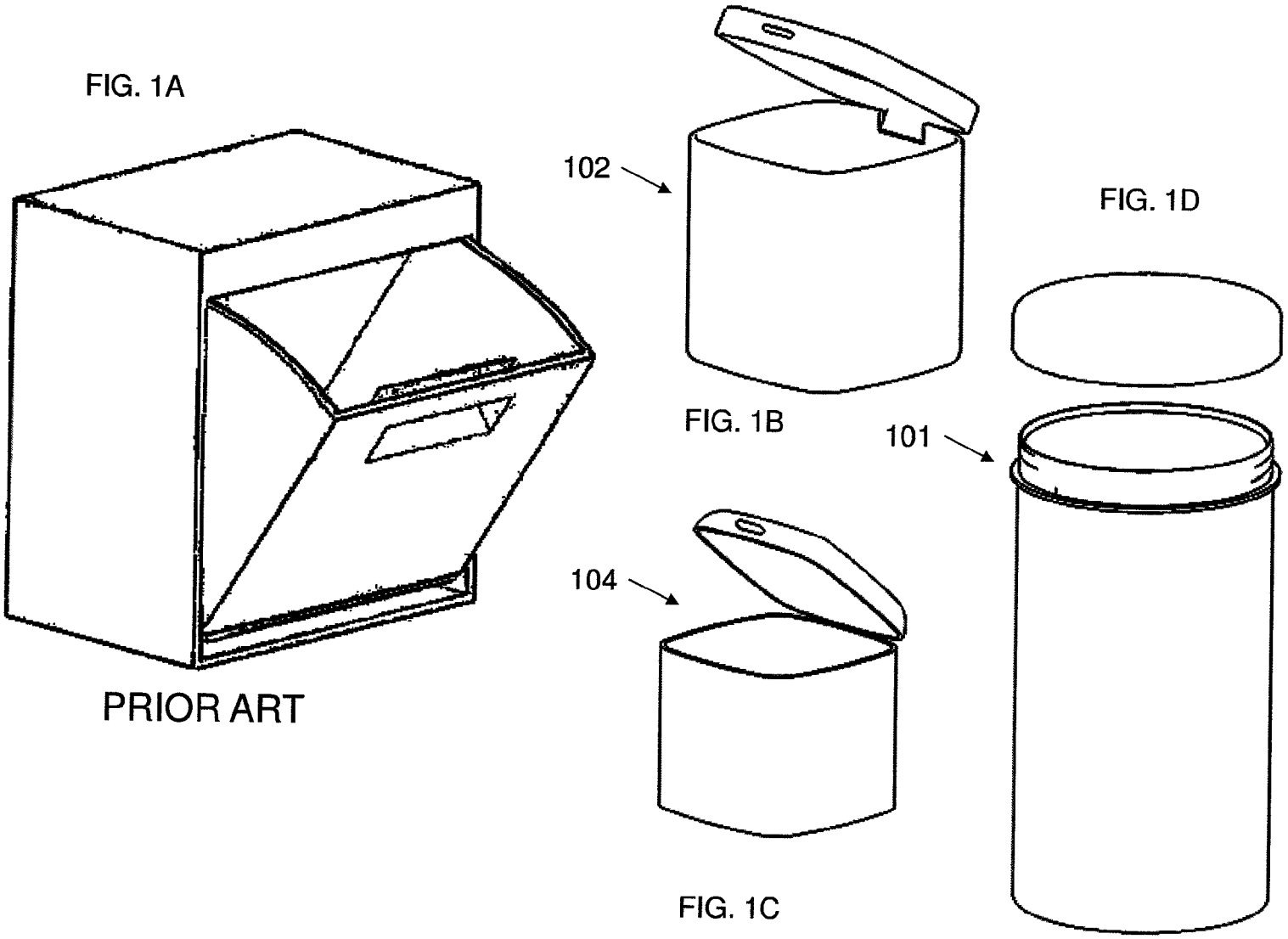
FIG. 1A PRIOR ART
FIG. 1A shows a prior art tilt bin as part of prior art container organization systems.
FIG. 1B-D are schematic diagrams of optional storage containers that may be utilized with optional embodiments of the present invention.

The principles and operation of the present invention may be better understood with reference to the drawings and the accompanying description. The following figure reference labels are used throughout the description to refer to similarly functioning components are used throughout the specification hereinbelow.

100 containers
101, 102, 104, 106 geometric container
201 holder assembly;
202 anterior opening
204 clasp, holder
204*a*, 204*b* flanking arms
204*c* top

204*d* bottom
208 backing;
208*a* first backing member;
208*b* second backing member;
208*c* backing recess,
208*d* pivot
208*e* angled surface
206 mediating member
206*a,b* connectors;
206*c* connector;
340 frame type mounting unit;
400 organization system
401 system frame
403 horizontal support structures
402 connector slot
405 vertical support structures
406, 406*a*, 406*b* connector slots
410 intersection
410*a* right recess
410*b* left recess
410*b* "C" shaped coupler;
412*a* left arm
412*c* protruding end
412*b* right arm
412*d* protruding end
500 case
502 carrying handle
504 mounting sockets
600 organization system
602 carrying handle
604, 606 opening
1100 base
1400 a base
1401 mobile container organization system
1407 mobile container organization system
1402 mounting support members
1404 handle
1500 container organization system
1501 mounting member panel frame;
1501*u* panel upper portion;
1501L panel lower portion;
1501*a* upper rail anterior portion;
1501*b* lower rail anterior portion;
1502 stackable panel connectors;
1502*f* female coupling member;
1502L lower edge rail recess;
1502*m* male coupling member;
1504 medial portion; coupling member;
1504*u* upper rail recess;
1504L lower recess;
1504*w* surface mount recess;
1510 container holding assembly;
1512 clasp/holder;
1512*a* clasp/holder anterior portion;
1512*p* clasp/holder posterior portion;
1512*o* holder anterior opening;
1512L Left flanking clap arms;
1512R Right flanking clasp arm;
1512E lower surface retaining member;
1512*s* retaining surface;
1514 mediating member;
1514*f* mediating member frame;
1514*u* mediating member frame upper surface;
1514L mediating member frame lower surface;
1514*b* pivoting peg
1514*a* positioning/angulation peg
1514*r* stress relief recess;
1516 clasp backing;
1516R backing right side wall;
1516L backing left side wall;
1516*a* backing angled surface;
1516R backing right side;
1516*b* backing upright surface;
1518 bifurcated recess;
1518*a,b,c* stop positions
2000 tool carrying device;
2002 handle;
2008 indentation/recess;
2012 tool rack;
2010 opening;

FIG. 1A shows an example of prior art organizing containers forming an organization system, in the form of a tilt bin. Such tilt bins are limited in that they do not allow for tilting or positioning a container while maintain the container in a closed formation. That is if a user wants to gain access to the container contents he must tilt the bin to gain access, or pull a drawer. Similarly a user cannot securely store the contents in a tilted or angled position and maintain it the container covered with a lid. Such prior art tilt bins and similar organization systems are without a lid and therefore access to the contents is allowed only while in the open formation. Therefore state of the art container and bins organization system are limited in that access to the container contents are limited only to when the container is tilted or drawn. Furthermore secured storage (closed with a lid) of the container contents is only possible when the bins/containers are in the upright position (not tilted) or drawn.

Figure 2E:
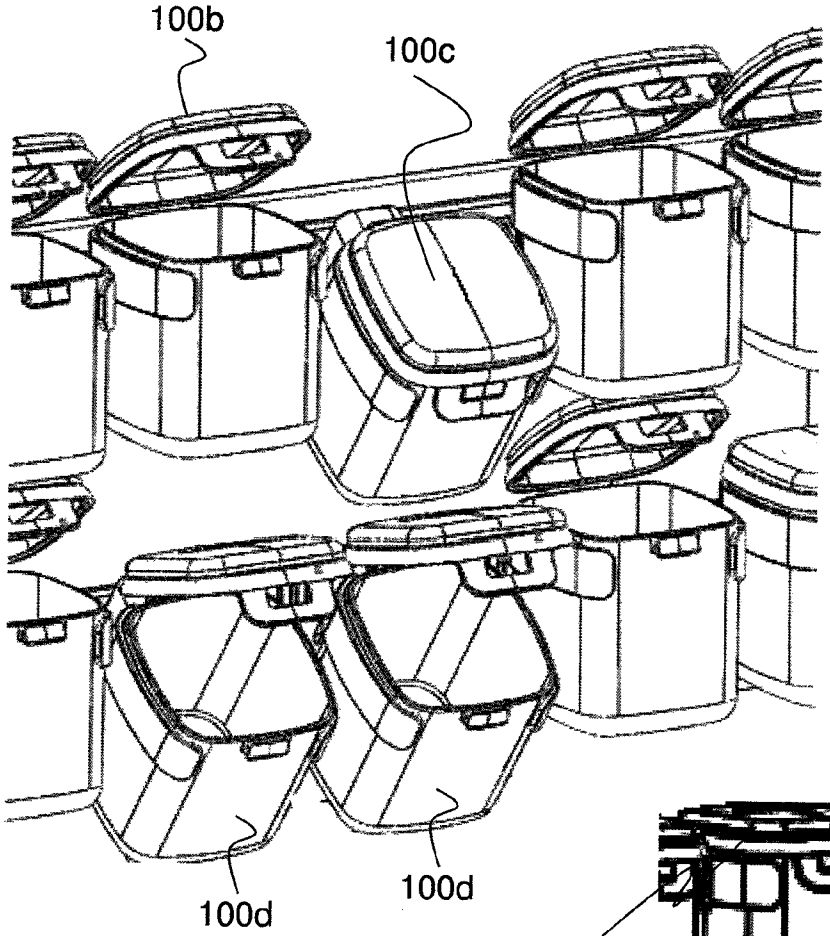
FIG. 2A-E are schematic diagrams of optional container holder assembly and containers according to optional embodiments of the present invention.
Figure 2A:
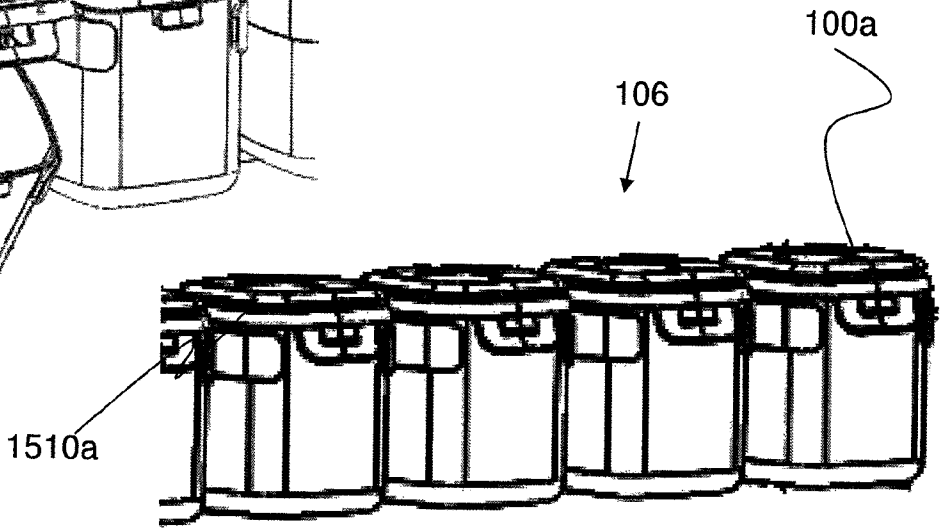

The present invention overcomes these deficiencies of the background art by providing a container organizing apparatus (1510, 201) and system (1500, 400). Most preferably, the apparatus (1510, 201) and system (1500, 400) according to the present invention provides for organizing containers, tools and container contents for example including but not limited to containers, bins and/or bottles, where the container and its contents may be stored (closed formation, with a closed lid) or accessed (open formation, with an open lid) in any position and more preferably in at least two position relative to a mounting surface, comprising an upright position 100*a, b* and at least one or more tilted or angled positions 100*c,d*, for example as shown in FIGS. 2E and 2A. FIG. 2A shows containers 106 in the upright closed position 100*a*. FIG. 2E shows containers 106 in various position both tilted/angled and upright in both the open and closed formation, for example including but not limited to tilted position and open container formation 100*d*, tilted position and closed container formation 100*c*, upright position and open container formation 100*b*, and upright position and closed container formation 100*a*, Similar view is provided in FIG. 12A, as part of an optional case 500. Optionally and preferably an optional containers 100 may be positioned about any optional mounting surface, for example frame 340, panel 1501, case 500 or the like, in at least two positions relative to the mounting surface in both the open or closed formation. For example the two positions may including an upright positions that is substantially parallel to the optional mounting surface, as shown for example containers 100*a,b*, and a tilted/angled positions, for example containers 100*c,d*, as shown at about 45 degrees to the mounting surface. Optionally and preferably at either tilted or upright position an optional container 100 may be provided in either the open configuration 100*b,d* or closed configuration 100*a,c*, as shown.

FIGS. 1B-D shows optional containers that may be used with the apparatus and system of the present invention. FIG. 113 shows cylindrical container 101 with a detachable lid.

FIG. 1B shows a square container 102 having a lid comprising an internal hinge while FIG. 1C shows a square container 104 comprising an external and/or built in hinge (not shown). Optionally the lids of any of the containers 100, 101-106 may be fit with a seal about its lid so as to form a tight seal and/or a vacuum allowing one to maintain the container contents fresh. FIG. 1B-D depict optional containers 100 in various geometric forms and lid assemblies 101, 102, 104, 106, having an externally smooth surface that may be coupled to a clasp 204 according to the present invention, for example as shown in FIG. 2A-D. Optionally a clasp and/or holder may be utilized anywhere along a container's outer surface. Optionally the clasp may be coupled to the container body (FIGS. 2A and 2D) and/or lid (FIG. 2B), container lower surface (FIG. 2B) or both container body and upper/lower surface (FIG. 6A), or any combination thereof.

Optionally, the containers and lids may take the form of any geometric shape that can have a corresponding clasp attach thereto.

Optionally the external surface of the containers may further comprise a groove, recess, or indentation, peg or the like specialized contact location for associating with a clasp utilized in the current invention.

FIGS. 2A-2D shows a plurality of optional containers in association with their respective clasps 204, 1512 and/or clasp arm 204*a,b*, 1512R,L. FIG. 2A shows a row of individual containers 106 comprising a seal about its lid (not shown), each container is associated with a clasp arms 1512R, L.

Figure 2B:
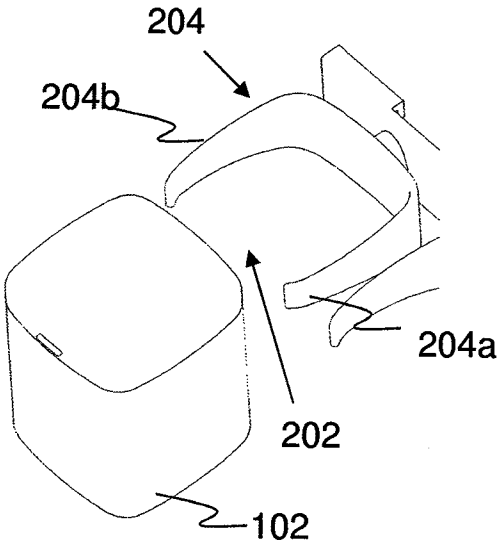

FIG. 2B depicts top down view of an optional container 100 in the form of container 102 adjacent to an optional clasp 204 according to the present invention. Most preferably, clasp 204 is provided for holding a container, for example containers 100-106 shown in FIG. 1B-D. Clasp 204 comprises an anterior opening 202, most preferably opening 202 defined by two flanking arms 204*a* and 204*b* of clasp 204 disposed on either side of the opening 202 and most preferably corresponding to the shape of the container to be held, for example semicircular arms 204*a,b* provided to correspond to a circular shaped container 101. Optionally a container 100 may be held with at least one or more clasps 204, disposed about its height, optionally the number of clasps 204 required to hold a container 100 may be dependent on the size, for example height or length of the container 100-106.

Figure 2C:
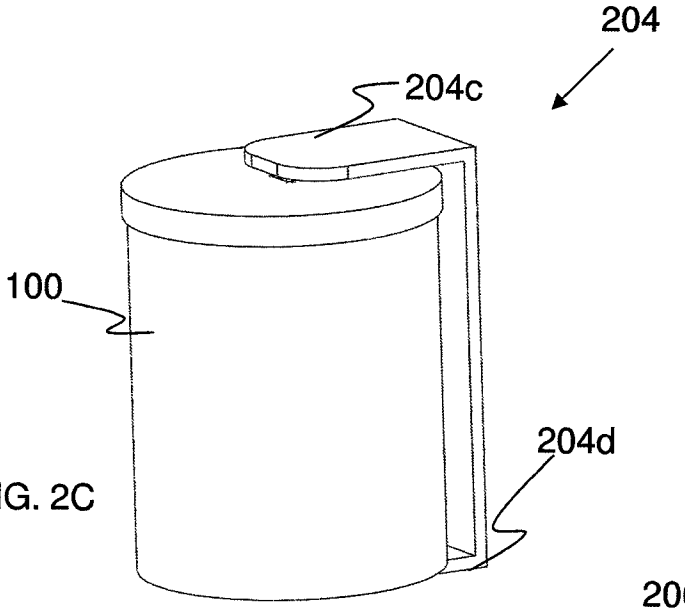

FIG. 2C provides a perspective view of another optional, illustrative embodiment in which clasp 204 optionally holds a container, such as container 100, from the top 204*c* and bottom 204*d* (as opposed to the sides), vertically. All of the optional embodiments described below may also optionally feature this configuration of clasp 204.

Figure 2D:
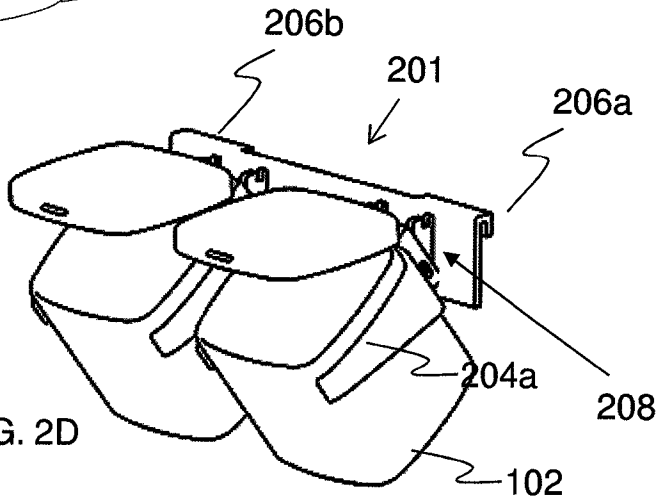

FIG. 2D shows a container holder assembly 201 according to an optional embodiment, that allows for holding an optional container for example container 100-106, about arms 204*a,b*, while providing for tilting the container about at least one or more controllable angle, (relative to a mounting surface) for example up to about 180 degrees more preferably about 30 degrees, about 45 degrees, about 60 degrees or about 90 degrees, or the like.

Holder assembly 201 according to an optional embodiment of the present invention provides for holding at least two containers, optionally holder assembly may be provided such that a single container may be disposed thereabout, for example as depicted with holder assembly 1510. Holder assembly 201 comprises clasp 204, backing support 208 and mediating member 206. Most preferably clasp 204 provides for associating a container onto holder assembly 201 via arms 204*a,b*. Most preferably mediating member 206 provides for associated holder assembly with a mounting member provided for mounting holder assembly 201 onto a surface. Optionally mediating member 206 may provide for directly mounting assembly 201 onto a mounting surface.

Most preferably backing 208 provides for and facilitates associating clasp 204 with mediating member 206 while providing holder assembly 201 means for tilting a container at a controllable angle when associated with holder assembly 201. Most preferably backing 208 facilitates tilting container 100-106 relative to a mounting surface providing a container with up to about 180 degrees, more preferably about 30 degrees or about 60 degrees or about 90 degrees or about a 45 degree angle relative to an optional mounting surface.

Figure 3C:
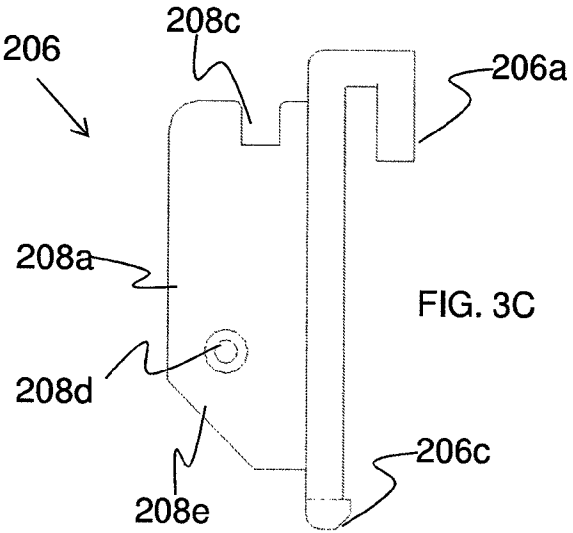
FIG. 3A-C are schematic diagrams of an optional mediating member and holder backing according to an optional embodiment of the present invention.
Figure 3A:
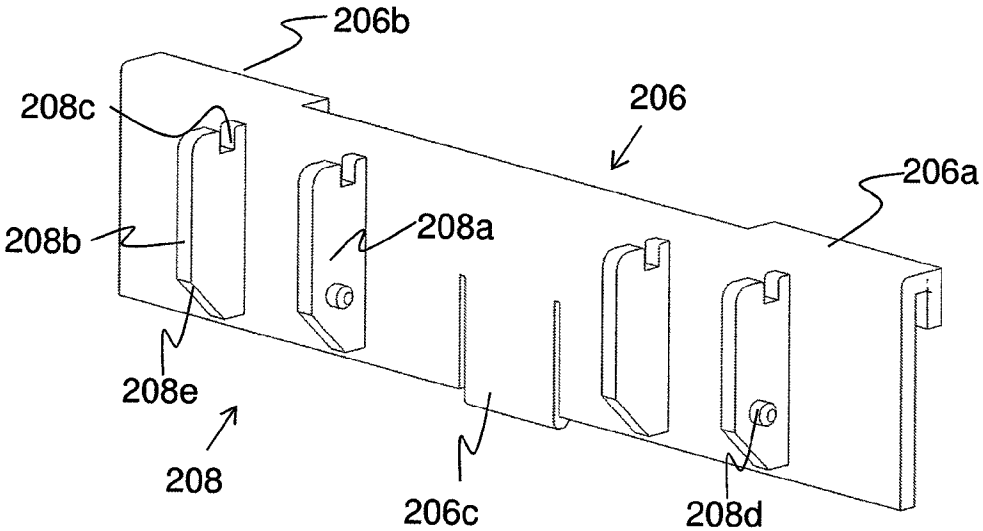
Figure 3B:
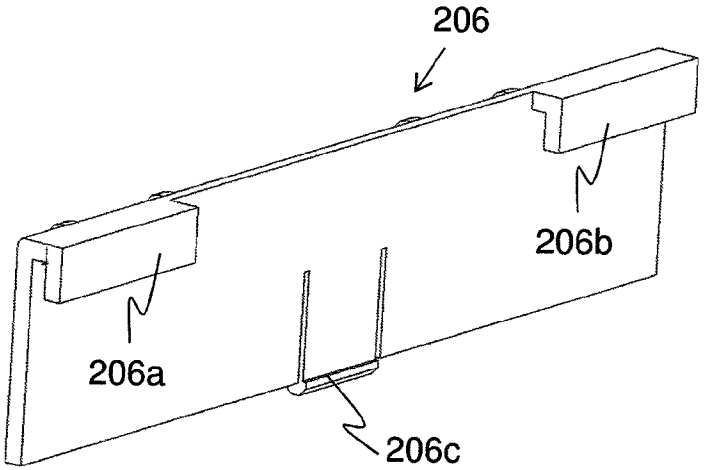

FIGS. 3A-C provide various views of holder assembly 201 showing a detailed view of mediating member 206 and backing 208, removed from holding assembly 201 and clasp 204. FIG. 3A shows a perspective anterior view of mediating member 206 revealing a portion (posterior) backing 208. FIG. 3B shows a perspective posterior view of mediating member 206. FIG. 3C shows a face on side view of about the right side of mediating member 206.

Optionally holder assembly 201, 1510 according to the present invention may be configured to include at least one or more clasps about a single mediating member. For example mediating member 206 provides one embodiment showing a dual clamp 204 embodiment while mediating member 1516 (FIGS. 5-8) shows a single clamp 1512 embodiment. Optionally and preferably clasp 204 may be coupled and/or integrated with holder assembly 201 via a mediating member 206 about backing 208. Optionally backing member 208 may be provided in optional forms for example including but not limited to stationary or non-stationary formation, preferably rendering clasp 204 stationary (substantially parallel to the mounting surface) or non-stationary (at an angle relative to a mounting surface). Optionally backing member 208 may be provided with an optional angle for example about 45 degrees, 90 degrees, 30 degrees or the like from about 0 (zero) degrees to about 90 degrees. Optionally backing member 208 may be provided in optional forms comprising at least one or more portions.

FIG. 3A shows an anterior view of mediating member 206 showing an optional integrated backing 208 member including a first backing member 208*a*, a second backing member 208*b*, backing recess 208*c*, pivot 208*d* and backing angled surface 208*e*. Most preferably backing 208 may be readily associated and/or disassociated with a corresponding backing member portion disposed about a clasp 204 (not shown).

Most preferably backing 208 facilitates and provides for positioning holding assembly 201 relative to mediating member 206 and/or a mounting surface (not shown). For example clasp 204 may be provided with at least one or more optional angles, for example about 45 degrees, or a range of angles optionally from about 0 (zero degrees) to 90 degrees. Optionally and preferably backing 208 provides for tilting container associated with holder assembly 201 via recess 208*c*, pivot 208*d* and angled surface 208*e*, as described in FIG. 4A-C.

Optionally and most preferably angled surface 208*e* corresponds to the tilting and/or angle provided for holding assembly 201.

Optionally mediating member may be provided with at least one or more connectors 206*a-c* for coupling holding assembly 201 to optional mounting surface and/or mounting member for example, mounting frame 340 (FIG. 9A-D). Optionally, connectors 206*a-c* may be provided as a female connector where the corresponding male connector may be disposed about the mounting member, for example frame 340. Optionally connectors 206*a-c* may be provided centrally or at either ends of mediating member 206 for example as shown in FIG. 3B showing a posterior view of mediating member 206. Optionally, connectors 206*a-c* may be provided in a plurality of forms for example including but not limited to snap connectors, sliding connector, sliding snap connectors, sliding rail connector, lock and key or the like.

FIG. 3B shows mediating member 206 comprising at least two connectors 206*a* and 206*b* that are optionally and preferably disposed on an upper edge on either ends of mediating member 206, optionally and preferably about its upper surface, as shown. Optionally and preferably mediating member 206 further comprises connector 206*c* preferably disposed along the mediating member 206 about is lower surface, as shown.

FIG. 3C shows a face on side view of about the right side of mediating member 206, providing a closer depiction the anterior portion of mediating member 206 comprising of the posterior portion of backing 208 comprising recess 208*c*, pivot 208*d* and angled surface 208*e*. Most preferably backing member 208 provides for tilting and/or angling holder assembly 201 at a desired preset angled up to about 180 degrees for example including but not limited to about 45 degrees, about 30 degrees, about 60 degrees, or about 90 degrees, or the like. Optionally and preferably as will be described in FIG. 4A-C posterior portion of backing 208 provides for forming the tilt and/or angle with correspond backing anterior portion.

FIG. 3C further shows connectors 206*a* and 206*c* disposed about the posterior portion of mediating member 206, provided to facilitate mounting holder to assembly 201 about a mounting member and/or surface for example frame mounting member 340 (FIG. 9A-D).

Figure 4A:
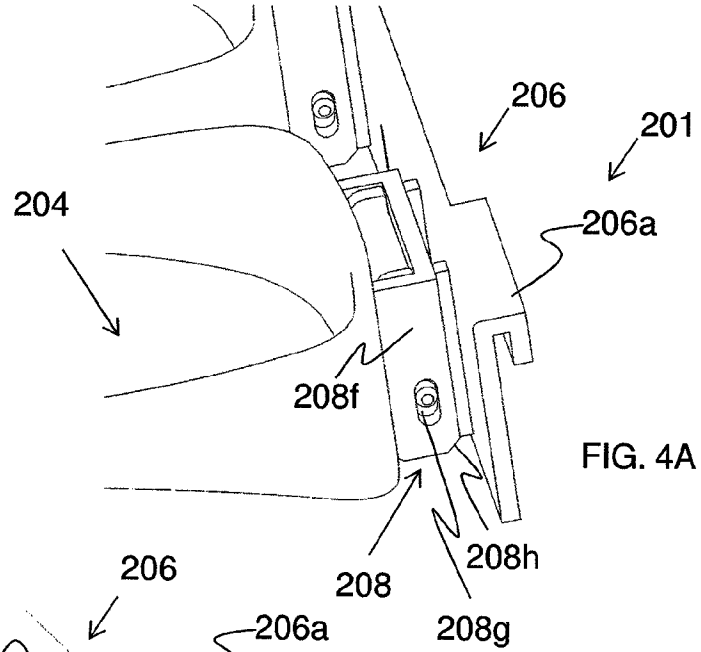
FIG. 4A-C are schematic diagrams of an optional holder backing according to an optional embodiment of the present invention.
Figure 4B:
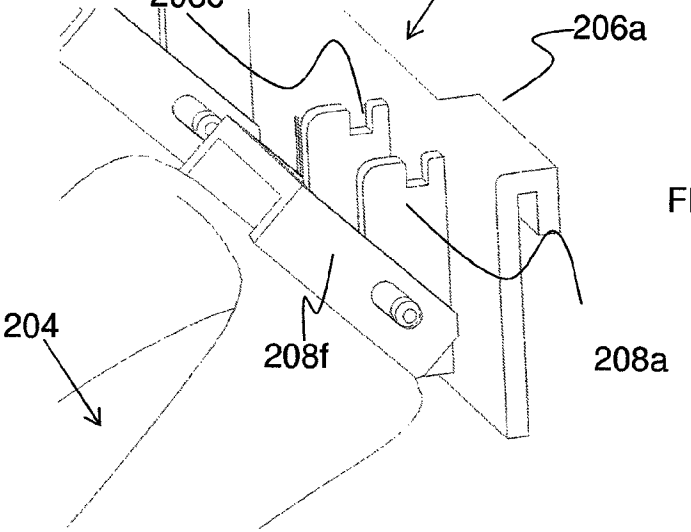
Figure 4C:
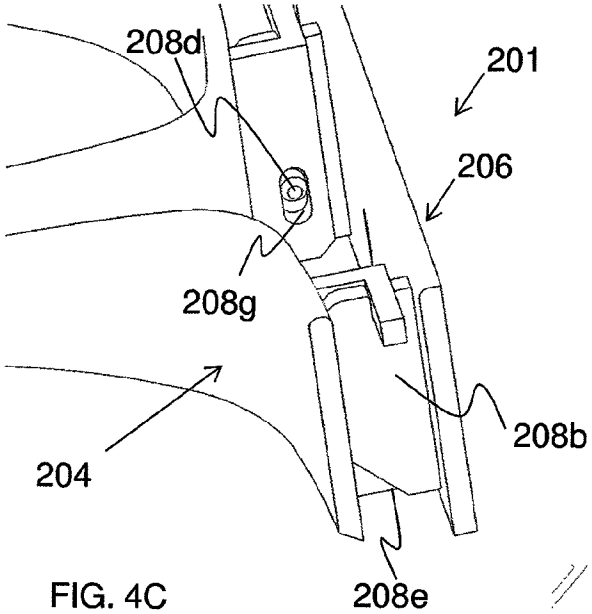

FIGS. 4A-C provide further close up view of the assembly backing member 208, comprising posterior portion members as shown and described in FIG. 3A-C, and anterior portion 208*f* shown in FIG. 4A-C, corresponding to backing member 208*a*, 208*b*, 208*c* and 208*d*. Most preferably anterior portion 208*f* comprises a recess 208*g* provided for receiving and associating with pivot 208*d* and an anterior angled surface 208*h* corresponding to posterior angled surface 208*e*. Most preferably anterior portion 208*f* may be associated and disassociated with backing member 208*a,b* about recess 208*c* such that anterior portion 208*f* latches onto recess 208*c* when holding assembly 201 is in the upright position (substantially parallel to a mounting surface and/or mediating member 206), for example as shown in FIG. 4A providing a perspective view and a cutaway view of FIG. 4C.

Most preferably when holding assembly 201 is tilted or angled, as shown in FIG. 4B, anterior backing 208*f* may be lifted to disassociate from groove 208*c*, therein moving pivot 208*d* from an upright position within recess 208*g* to an angled position about recess 208*g*, wherein anterior angled surface 208*h* rests about mediating member 206 while anterior backing 208*f* rests about posterior angled surface 208*e*. Optionally and most preferably posterior angled surface 208*e* and anterior angled surfaced 208*h* are disposed about parallel planes assuming the same angle, for example about 45 degrees, about 30 degrees, about 60 degrees, about 90 degrees, or any combination thereof.

As previously described backing member 208 is optionally provided in the form of latch-hinge, as shown, comprising a first member 208*a* and a second member 208*b*, a recess 208*c*, and pivot 208*d*. Non stationary mediating members provides for placing the held container in at least two optional positions at 90 degrees or at an angle of about 45 degrees.

FIGS. 5-8 collectively show an optional embodiment of the present invention for a container holding assembly 1510 that provides for tilting a container 100-106 associated with the holding assembly 1510, similar to that described with respect to holding assembly 201 of FIGS. 2-4. Holding assembly 201 provides a dual container holding assembly utilizing a mediating member 206 and backing 208 configured to associate and/or hold at least two container 100-106. Holding assembly 1510 proves a single container holding assembly utilizing a mediating member 1514 configured to hold one container 100-106 associated therewith.

Figure 8A:
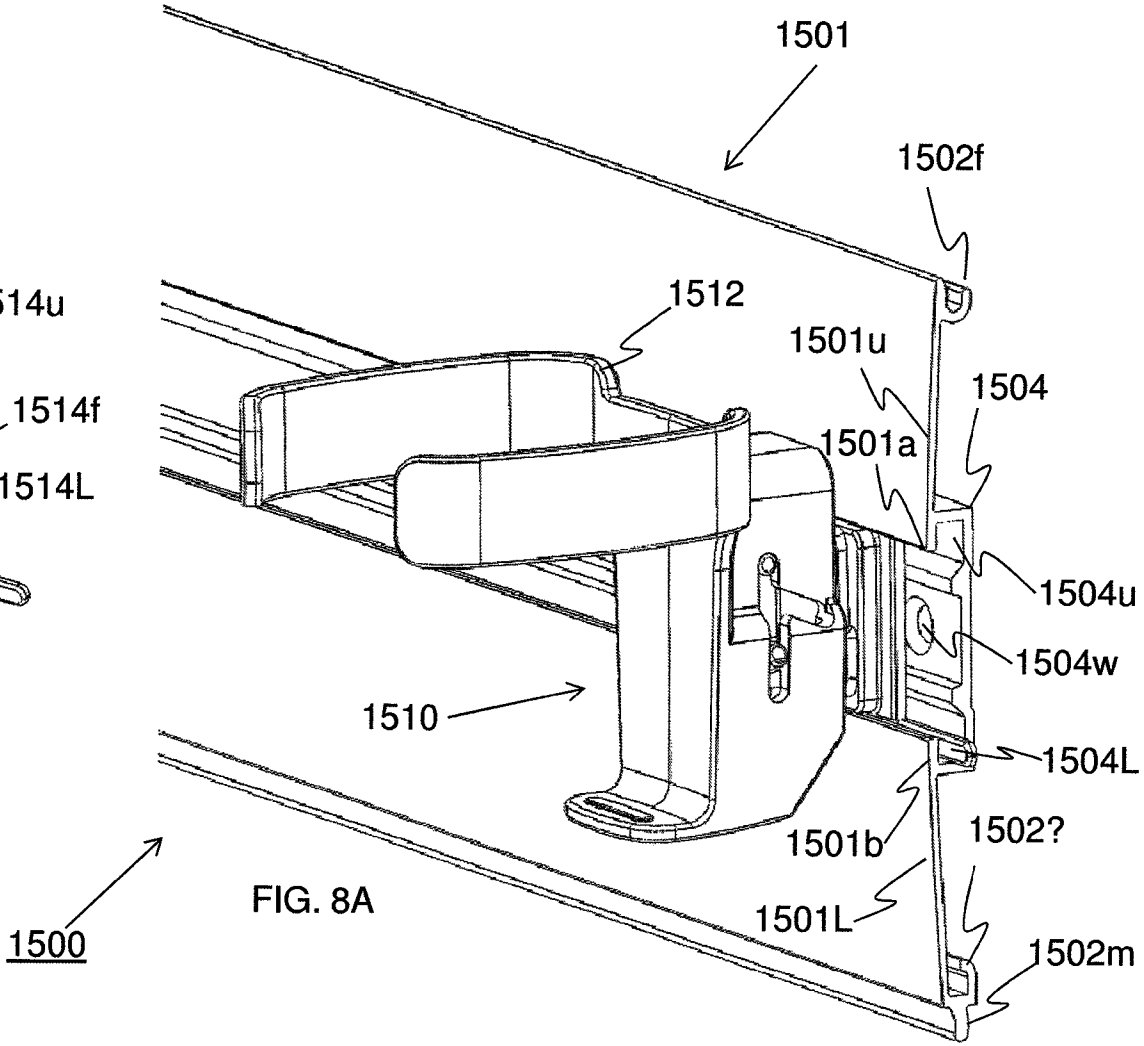
FIG. 8A is a schematic illustration of an optional embodiment of the present invention for a container organizational system associated with an optional mounting member and holder assembly, according to an optional embodiment of the present invention.

FIG. 8A shows an organizational apparatus 1500 according to an optional embodiment of the present invent for organizing bins and/or containers, for example containers 100, 101-106 as shown in FIG. 1B-D, and contents therein. Apparatus 1500 may for example be utilized for categorizing and/or organizing tools, parts, nuts, bolts, nails, crafts, electronic parts, electronic components, electronic circuit components, seeds, herbs, foodstuffs, candy, toys, or the like goods capable of fitting and storing within a bin and/or container 100-106 or the like. Apparatus 1500 most preferably comprises a container clasp and/or holder assembly 1510 that may be disposed about a mounting panel 1501.

Optionally and most preferably mounting frame 1501 may receive a plurality of container holder assembly 1510. Most preferably assembly 1510 comprising mediating member 1514 provides for coupling holder assembly 1510 onto frame 1501. Holder assembly 1510 is characterized in that it may be configured to allow to reposition a container 100-106 associated therewith, to assume at least one angle relative to the mounting frame 1501. Optionally, the angle formed by the holder assembly 1510 and mounting frame 1501 may be preset, for example include but is not limited to 45 degrees, 30 degrees, 60 degrees, or 90 degrees. Optionally holder assembly 1510 may be configured to accommodate and/or provide a plurality of preset angles for example include but is not limited to 45 degrees, 30 degrees, 60 degrees, or 90 degrees. Optionally, holder assembly 1510 may configured to allow toggling between a plurality of present angles. Optionally and preferably the angle may be variably set to including angles from about 0 degrees up to about 180 degrees.

Figure 16:
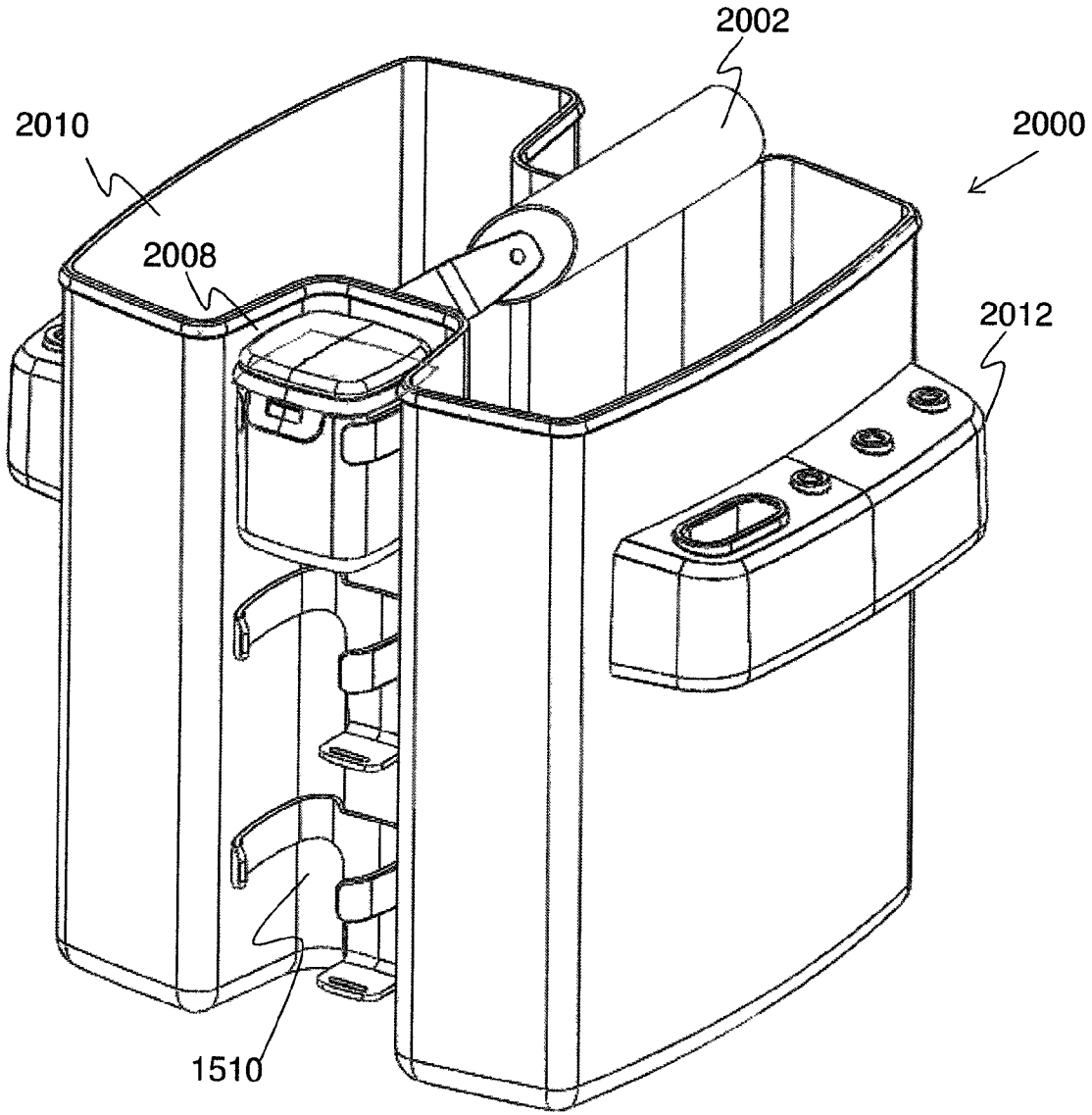
FIG. 16 shows an optional tool carrying and organization device shown in the form of a bucket, according to an optional embodiment of the present invention.

Optionally an organizing system 1500 may be formed by associating a plurality of holder assembly 1510 about a single mounting frame 1501 and/or by associating a plurality of mounting frames 1501 relative to and/or with other mounting frame panels 1501, for example as shown in FIG. 16.

Optionally and preferably mounting panel frame 1501 may be mounted about any surface, for example including but not limited to a wall, a backing, a support frame, board or the like. Optionally and preferably mounting frame 1501 about a surface (not shown) may be facilitated with a surface mount recess 1504*w*, providing for fixing and/or mounting about a surface such as a wall, for example utilizing a adhesive, screw, nail or the like.

Optionally holder assembly 1510 may be associated directly onto a surface (mounting surface), without panel frame 1501. For example holder assembly 1510 may optionally be coupled to a surface via a mediating member 1514.

Figure 8B:
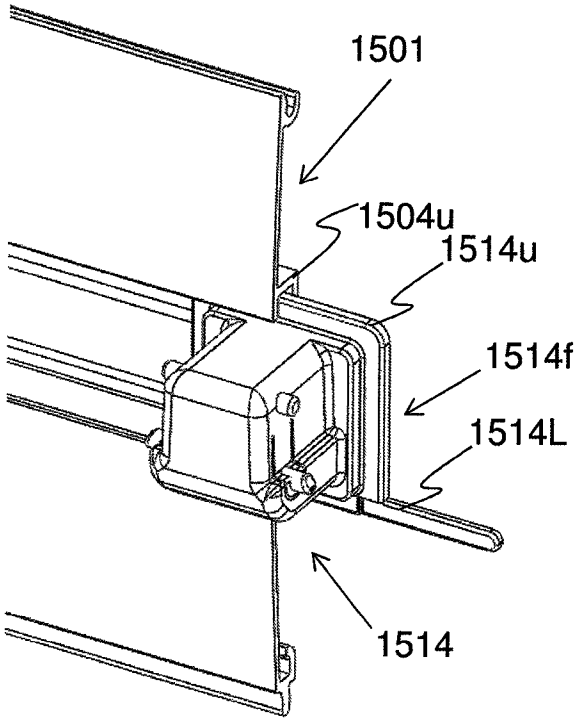
FIG. 8B is a schematic illustration of an optional embodiment of the present invention for a container organizational system comprising an optional mounting member associated with an optional mediating member, according to an optional embodiment of the present invention.

FIG. 8B shows a partial view of holder assembly 1510 showing how assembly 1510 may be associated with panel 1501, via mediating member 1514. Most preferably mediating member 1514 may slide into position along a rail 1504 via mediating member frame 1514*f*, for example as shown. Most preferably rail 1504 comprises an upper rail recess 1504*u* and a lower recess 1504L adapted to received a corresponding mediating member frame 1514*f* about upper surface 1514*u* and lower surface 1514L.

Most preferably, panel frame 1501 comprises an upper portion 1501*u* and a lower portion 1501L having a recess therebetween defined by a medial portion 1504. Optionally and preferably upper portion 1501*u* and lower portion 1501L extend from and are fluid with medial portion 1504.

Most preferably medial portion 1504 provides a panel mounting member or surface mounting member and for receiving holder assembly 1510, as shown.

Most preferably medial portion 1504 disposed about the posterior surface of panel 1501 may be provided in the form of a rail having an upper rail recess 1504*u* and a lower rail recess 1504L. Most preferably upper and lower rail recess 1504*u*, 1504L provide for coupling with mediating member 1514 as previously described.

Optionally and preferably medial portion 1504 extends from upper portion 1501*u* about its posterior surface at a distance from the lower edge of upper portion 1501*u*, defining anterior portion 1501*a* of upper rail 1504*u*. Optionally the distance from the lower edge of upper portion 1501*u*, defining the size of upper rail anterior portion 1501*a* may be customized and/or changed according to optional parameters. The size of portion 1501*a* may for example include but is not limited to be based on the materials properties of panel 1501, properties of mediating member 1514, properties associated with the material contained by assembly 1510, or the like.

Optionally and preferably medial portion 1504 extends from lower portion 1501*b* about its posterior surface at a distance from the lower edge of lower portion 1501L, defining anterior portion 1501*a* of lower rail 1504L. Optionally the distance from the lower edge of lower portion 1501L, defining the size of lower rail anterior portion 1501*a* may be customized and/or varied according to optional parameters. The size of portion 1501*a* may be customized based on optional parameters for example including but not limited to the materials properties of panel 1501, properties of mediating member 1514, properties associated with the material contained by assembly 1510, or the like.

Figure 8C:
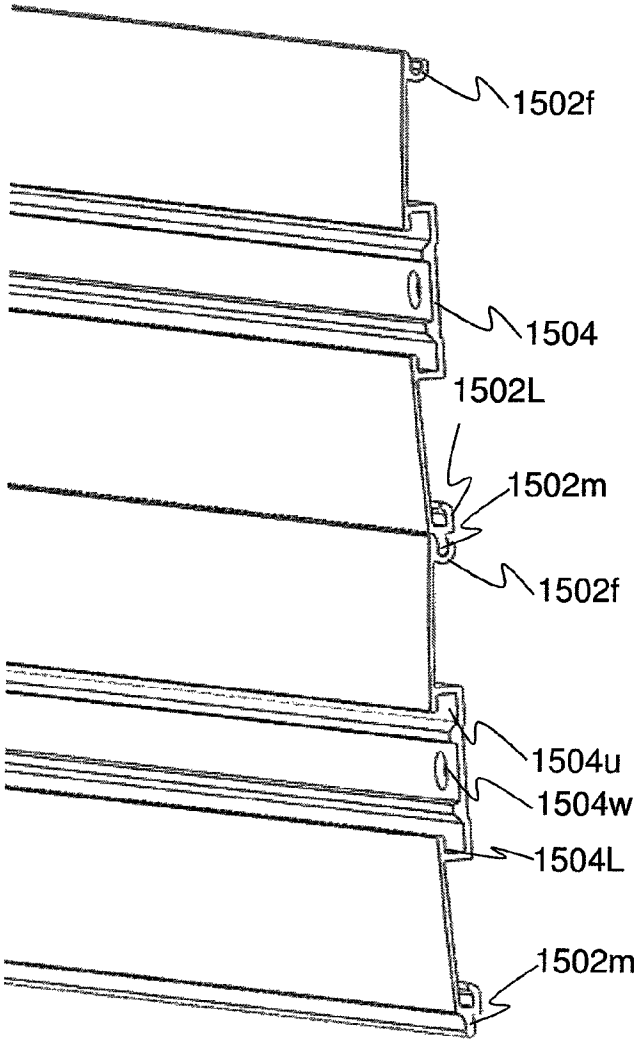
FIG. 8C is a schematic illustration of two optional mounting members shown in FIG. 8A that are coupled with one another, according to an optional embodiment of the present invention.

Most preferably panel 1501 comprises a stackable panel connector 1502, as shown in FIG. 8C. Optionally panel connectors 1502 provide for coupling panels 1501 with one another, about its upper portion 1501*u* and/or its lower portion 1501L. Optionally stackable panel connectors 1502 may be provided in the form of a male connector 1502*m* and a corresponding female connectors 1502*f*, for example as shown. Most preferably adjacent panels 1501 may be coupled in a stackable form where the upper portion 1501*u* of a first panel 1501 couples with the lower portion 1501L of a second panel 1501. Preferably each panel 1501 may be coupled with up to two adjacent panels 1501 about panel connector 1502, about each of the upper portion 1501*u* and lower portion 1501L.

Most preferably male coupling member 1502*m* is provided about the lower edge of lower panel portion 1501L. Male coupling member 1502*m* may be realized as railing disposed about the length of panel 1501 that extends posteriorily from the lower edge of panel portion 1501L. Most preferably male coupling member 1502*m* is designed to fit with and couple with, and correspond with a female coupling member 1502*f* disposed about an adjacent panel 1501, for example as shown in FIG. 8C.

Most preferably female coupling member 1502*f*, is provided about the upper edge of upper panel portion 1501*u*. Optionally female coupling member 1502*f* may be provided in the form of a recess, as shown, extending from the posterior portion of upper portion 1501*u*, near or about the upper its upper edge. Most preferably female coupling member 1502*f* is designed to fit with and couple with, and correspond with a male coupling member 1502*m* disposed about an adjacent panel 1501, for example as shown in FIG. 16.

Figures 5A, 5B, 5C, 5D:
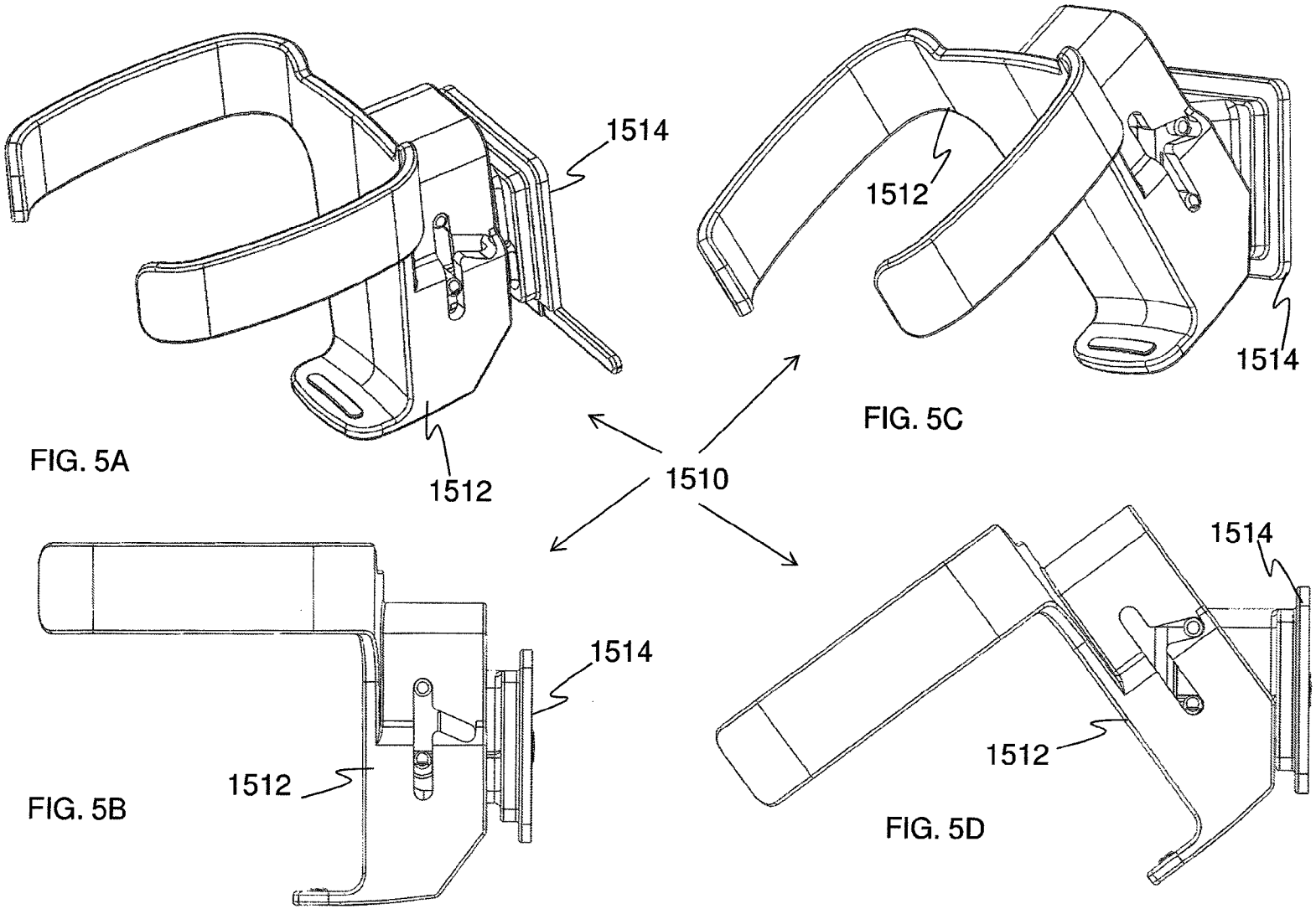
FIG. 5A-D show optional views of the container holding assembly according to an optional embodiment of the present invention.

FIG. 5A-D show optional views of the container holding assembly 1510 and assuming different angles. FIG. 5A-B show the container holding assembly 1510 in an upright position that is substantially parallel to the surface it is mounted on, for example a panel 1501 (not shown) and/or mediating member 1514. FIG. 5A shows a perspective view while FIG. 5B shows a side view.

FIG. 5C-D shows the container holding assembly 1510 in at an angled position, at about 45 degrees, relative to the mounting surface, for example a panel 1501 (not shown) and/or mediating member 1514. FIG. 5C shows a perspective view while FIG. 5D shows a side view.

Figure 6A:
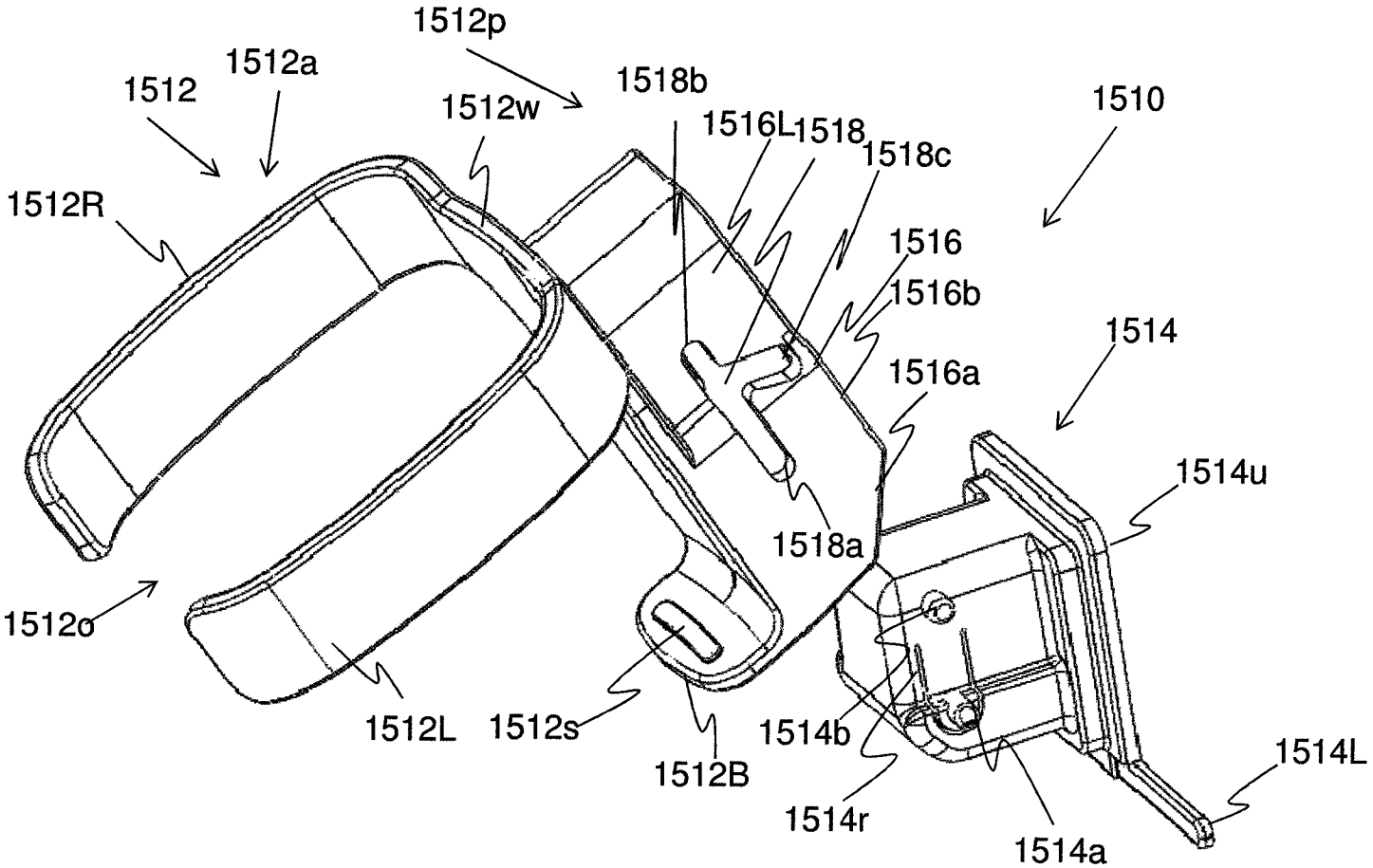
FIG. 6A-B show various exploded views of the container holding assembly and mediating member, according to an optional embodiment of the present invention.
Figure 6B:
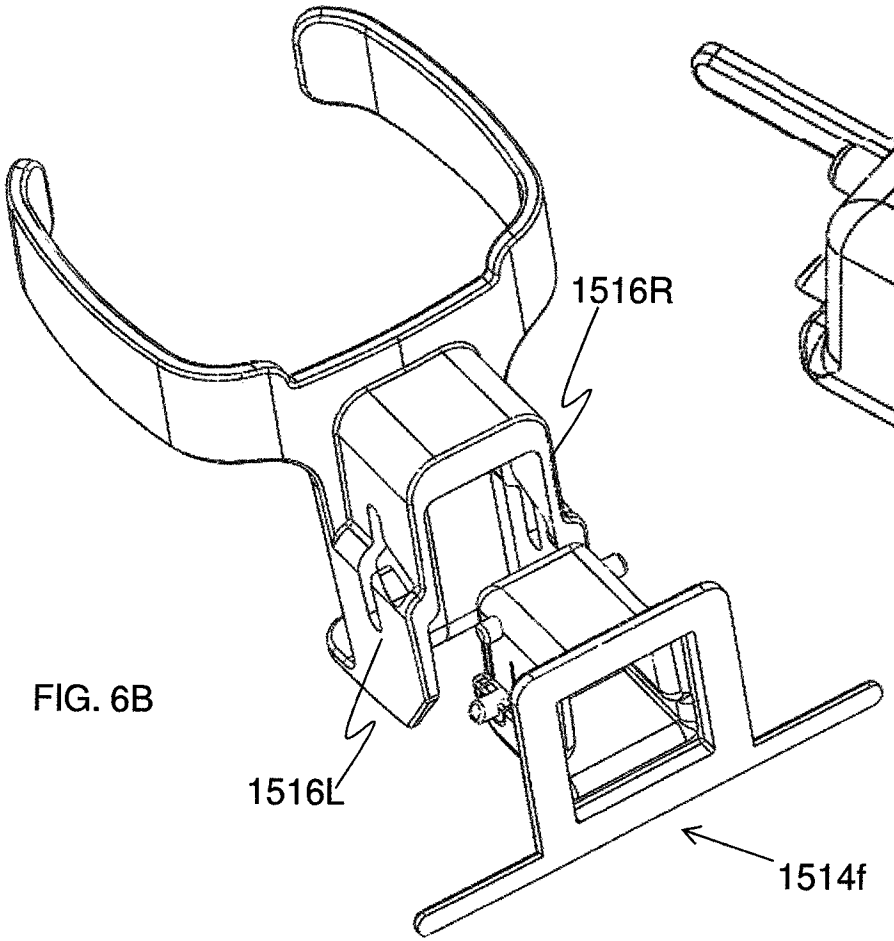

FIG. 6A-B show different exploded views of holder assembly 1510 comprising mediating member 1514 and container clasp/holder 1512. FIG. 6A shows a side view while FIG. 6B shows a posterior perspective view.

Container clasp and/or holder 1512 is most preferably provided from a single body. Optional holder 1512 may be provided from a variety of optional materials for example including but not limited to plastics, polymers, composites, alloys, hybrids, metals, metal alloys, any combination thereof, or the like materials.

Holder 1512 comprises an anterior portion 1512*a* and a posterior portion 1512*p*, separated by a wall 1512*w*. Most preferably anterior portion 1512*a* provides for receiving and holding a container 100-106. Most preferably posterior portion 1512*p* provides for and facilitates mounting about a surface as well as facilitates determining the position of holder member 1512 relative to the mounting surface. Most preferably wall 1512*w* providing central support structure for holding member 1512 interfacing and mediating between both anterior portion 1512*a* and posterior portion 1512*p*.

Anterior portion 1512*a* comprises right arm 1512R and a left arm 1512L flanking wall 1512*w* defining the width of an anterior opening 1512*o* provided for receiving and securely holding a container, for example containers 100, 101-106 for example as shown in FIG. 1B-D. Most preferably anus 1512R,L extend from either sides of wall 1512*w* about the upper portion of wall 1512*w*. Optionally the upper edge of arms 1512R,L may be fluid and/or continuous with the upper edge of wall 1512*w*. Most preferably arms 1512R,L are provided for holding and interfacing with a container about its side walls and corresponding to a container's width.

Optionally and preferably anterior portion further comprises a lower surface retaining member 1512B, extending about the bottom portion of wall 1512*w*, and defining the lower limit of opening 1512*o*. Optionally the lower and/or bottom edge of retaining member 1512B may be fluid and/or continuous with the lower edge of wall 1512*w*. Most preferably retaining member 1512B may be provided for holding and interfacing with a container about its bottom surface corresponding to a container's length and/or height. Optionally and preferably retaining member 1512B fluidly extends from wall 1512*w* having the same width, therein forming a base onto which a container's bottom side may rest and/or associate with. Optionally, retainer member 1512B may comprise a retaining surface 1512*s* for further interfacing and retaining the bottom surface of a container. For example retaining surface 1512*s* may be provided as a textured surface providing increased surface area for retaining a container. Optionally retaining surface 1512*s* may be provided in the form of a recess for receiving a corresponding container peg. Optionally retaining surface 1512*s* may be provided as an extension providing for pressure fitting a container about retainer 1512B within opening 1512*o*.

Most preferably arms 1512R,L and lower surface retainer 1512B may be defined by the dimensions, shape of the container to be maintained. Optionally opening 1512*o* may be provided in any size and/or shape to suite optional and/or customized containers. Optionally opening 1512*o* preferably corresponding to the shape of the container to be held, for example semicircular to correspond to a circular shaped container 101, quadrilateral corresponding to container 102-106 having a square profile.

Most preferably posterior portion 1512*p* comprises backing 1516 extending posteriorily from wall 1512*w*, forming a housing provided for receiving mediating member 1514, therein facilitating mounting of assembly 1510. Most preferably backing 1516 comprises three surfaces extending from wall 1512 forming two side walls 1516R,L mediated and/or bridged with a roof. Most preferably backing 1516 forms an opening corresponding to the shape and form of mediating member 1514. Optionally backing 1516 forms an arch-like member extending between the bottom right surface of wall 1512*w* to the bottom left surface of wall 1512*w*, defining a right backing side wall 1516R and a left backing side wall 1516L.

Most preferably backing 1516 facilitates positing of holder assembly 1510 at an angle relative to a mounting surface with a bifurcated recess 1518 disposed about each side wall 1516R,L. Optionally and preferably backing 1516 is further provided with at least one angled surface 1516*a* provided to facilitate positing of holder assembly 1510 at an angle relative to a mounting surface, for example with angled surface 1516*a*, or parallel to a mounting surface, for example with surface 1516*b*. Optionally and preferably the posterior end of lower surface of each of side walls 1516R,L is provided with an edge cut forming an angle, for example as shown, to correspond to the positioning angle to be assumed by holder assembly 1510. Optionally, angled surface 1516*a* may provided with a plurality of angles up to about 180 degrees, for example including but not limited to about 45 degrees, about 60 degrees, about 30 degrees, or about 90 degrees, or the like. Optionally and preferably surface 1516*a* is provided with a 45 degree angle, as shown.

Most preferably bifurcated recess 1518 provides for position holder assembly 1510 relative to the mounting surface and in conjunction with mediating member 1514, in a plurality of optional positions, in at least an upright position, as shown in FIG. 5A-B and an angled position as shown in FIG. 5C-D. Optionally and preferably bifurcated recess 1518 comprises at least 3 stop positions 1518*a,b,c* corresponding to at least two 2 optional holder assembly positions, most preferably an upright position parallel to the mounting surface (FIG. 5A-B) corresponding to stop positions 1518*a* and 1518*b* and an angled position (FIG. 5C-D) corresponding to stop positions 1518*a* and 1518*c*. Optionally recess 1518 may comprise a plurality of stop position (s) corresponding to a plurality of holder assembly positions. Optionally, bifurcated recess 1518 may provided with a plurality of bifurcations corresponding to a plurality of angles up to about 180 degrees, for example including but not limited to about 45 degrees, about 60 degrees, about 30 degrees, or about 90 degrees, or the like. Optionally each bifurcation corresponds to a specific angle for example selected from about 30 degrees, about 45 degrees and about 60 degrees, or the like.

Most preferably bifurcated recess 1518 comprise a plurality of stop positions 1518*a,b,c* provided for receiving and positioning a peg 1514*a,b* disposed about mediating member 1514, provided to define the position of holder assembly 1510 relative to a mounting surface. Optionally and preferably bifurcated recess 1518 is provided with a bifurcation angle corresponding to the angle surface 1516*a*, optionally and preferably substantially defining parallel planes. For example, the angle formed between stop positions 1518*a* and 1518*c* define an angle corresponding to the angle of surface 1516*a*, and stop positions 1518*a* and 1518*b* correspond to the angle of surface 1510, substantially upright.

Most preferably bifurcated recess 1518 is provided to receive and couple or otherwise associate with mediating member 1514 about at least two pegs 1514*a,b*. Most preferably peg 1514*b* provides a pivoting peg that is maintained in a constant relative position to the mounting surface and associated with bifurcated stop position 1518*b*. Most preferably peg 1514*a* provides a position and/or angulation peg 1514*a* allowing to position holder assembly 1510 at an angle relative to the mounting surface. Most preferably positioning peg 1514*a* is toggled between at least two stop positions, for example 1518*a* and 1518*c*. Optionally the number of stop position depending on the number of bifurcation and angles provided.

For example, as shown in FIG. 5A-B when peg 1514*a* assume stop position 1518*a* and peg 1514*b* assume stop position 1518*b* holder assembly 1510 assumes an upright position that is substantially parallel with the mounting surface.

For example, as shown in FIG. 5C-D when peg 1514*a* assume stop position 1518*c* and peg 1514*b* assume stop position 1518*b* holder assembly 1510 assumes an angled position that is substantially at a 45 degree angle, also corresponding to the angle of angled backing surface 1516*a*.

Figure 7:
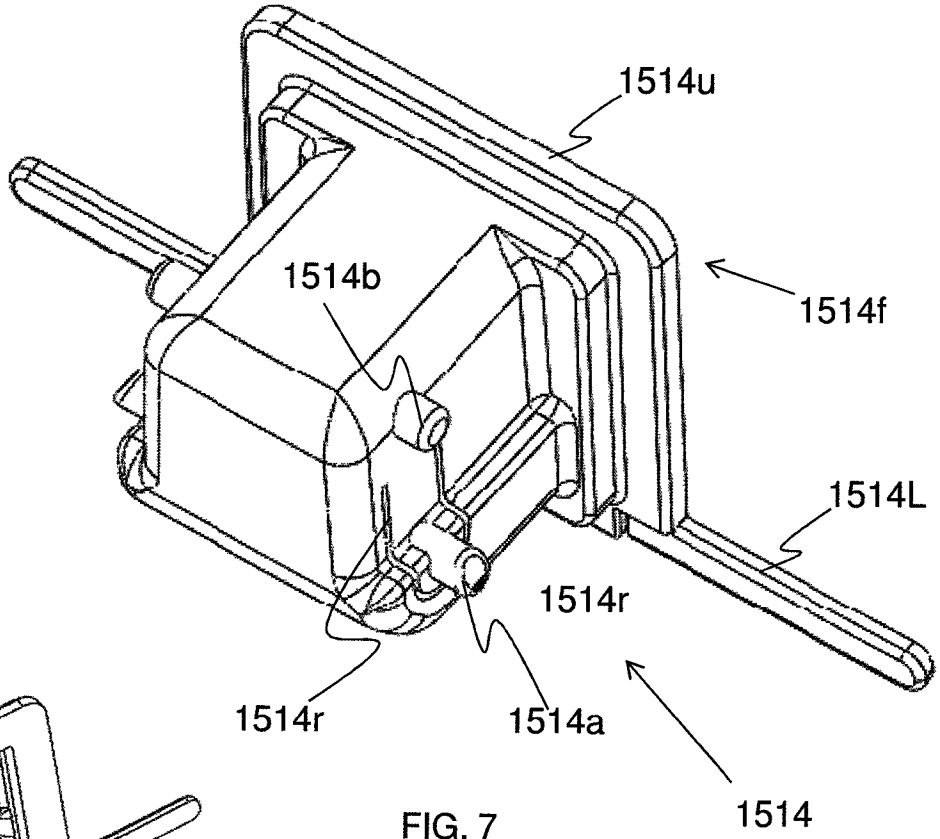
FIG. 7 shows a perspective close up view of an optional mediating member, according to an optional embodiment of the present invention.

Mediating member 1514, a close up view of which is seen in FIG. 7, comprises a posterior portion and an anterior portion. Most preferably the posterior portion is defined by a mediating member frame 1514*f* provided to facilitate coupling and/or otherwise associating with panel rail 1504 as previously described. Most preferably mediating member 1514 may slide into position along a rail 1504 via mediating member frame 1514*f*. Most preferably rail 1504 comprises an upper rail recess 1504*u* and a lower recess 1504L adapted to received a corresponding mediating member frame 1514*f* about upper surface 1514*u* and lower surface 1514L. Optionally lower surface 1514L is elongated to facilitate spacing between adjacent containers, sliding, positioning, moving holder assembly 1510 about rail 1504.

Figure 12B:
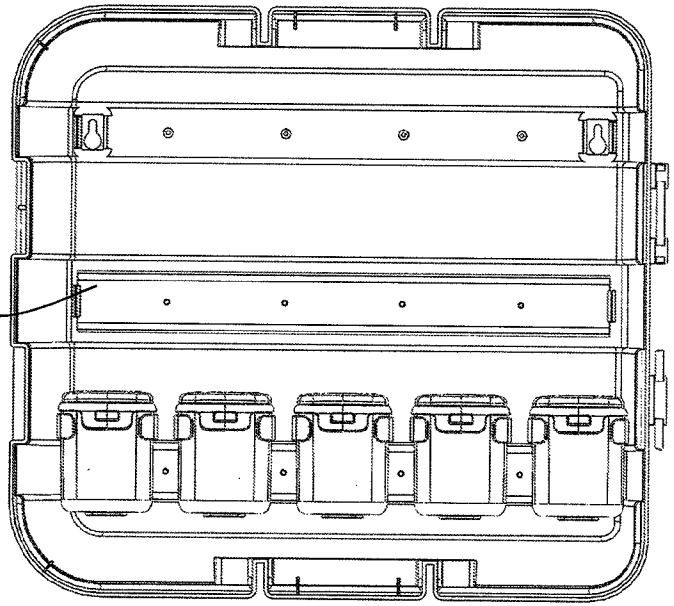
FIG. 12A-C are schematic diagrams of an optional embodiment of the present invention for a carrying case comprising the holding assembly according to an optional embodiment of the present invention.
Figure 12C:
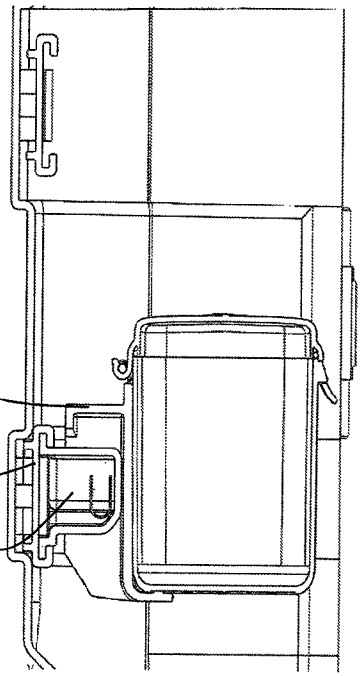
Figure 12A:
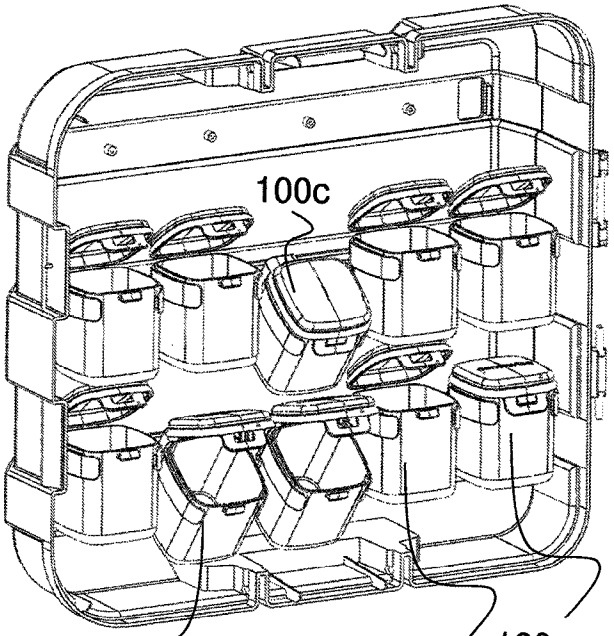
Figure 13A:
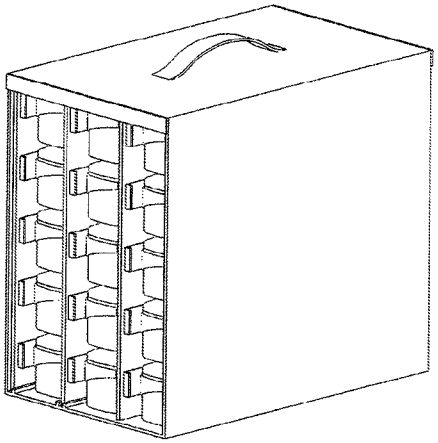
FIG. 13A-D are schematic diagrams of an optional carrying case comprising a plurality of modular mounting units, according to an optional embodiment of the present invention.
Figure 13B:
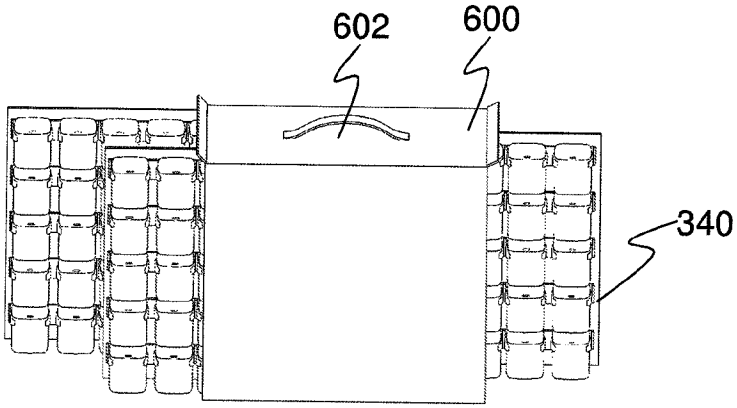
Figure 13C:
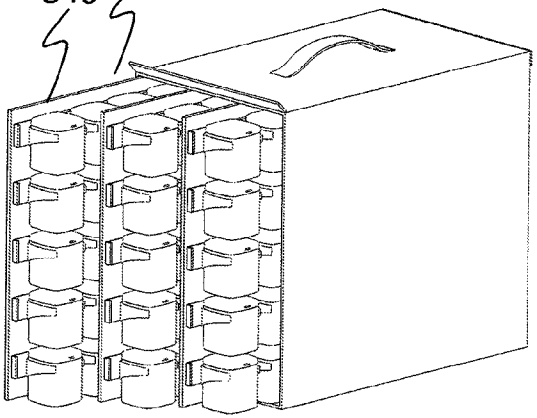
Figure 13D:
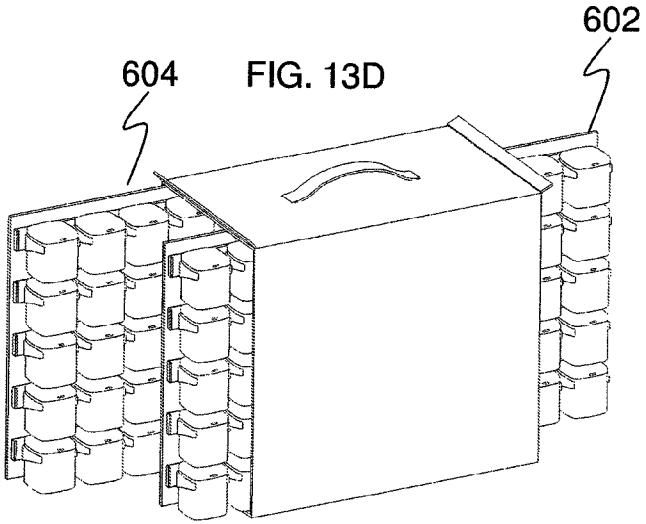

Optionally rail 1504 may serve as a mounting member when it is associated with a mounting surface about recess 1504*w*. For example, as shown in FIG. 12A-C where a rail 1504 mounting member may be incorporated onto the inner surface of a carrying case 500 or tool box, or briefcase as shown in FIG. 12A-C.

Most preferably, mediating member 1514 posterior portion provides for associated with holder 1512 about backing 1516 and particularly bifurcated recess 1518, as previously described, and best seen in FIG. 6B. Most preferably pegs 1514*a,b* are configured to couple and associated with bifurcated recess 1518 and toggled and/or maneuvered between stop positions 1518*a,b,c*.

Optionally and preferably mediating member 1514 comprises a recess 1514*r* surrounding positioning/angulation peg 1514*a*, provided as a stress absorbing means when holder assembly 1510 is provided in an angled position (FIG. 5C-D).

FIGS. 9A-D provide a plurality of views of an optional embodiment of the present invention for a modular organization system and apparatus comprising a tilt-able holding assembly 201 that is associated with a modular frame type mounting unit 340. Although FIG. 9A-D show frame mounting unit 340 associated with holding assembly 201, frame mounting unit 340 may be configured to receive holding member 1510.

Figure 9A:
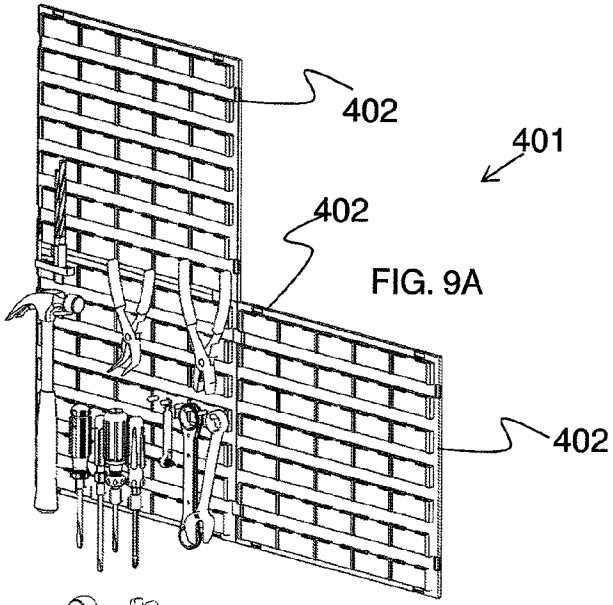
FIG. 9A-D are schematic diagrams of a modular organizational system using a frame based mounting member, according to an optional embodiment of the present invention.
Figure 9B:
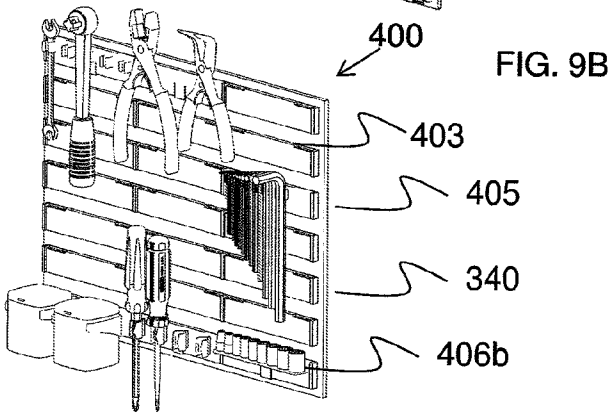

FIG. 9B depicts organization system 400 comprising at least one quadrilateral frame mounting member 340, optionally and preferably a square or rectangle. Organization system 400 shows that a modular organization system may be configured utilizing a plurality of optional frame mounting members with various holding member assembly 1510 and/or 201 and/or other stationary tool holding members, as shown.

FIG. 9A shows an optionally organization system 401, including a plurality of frame mounting units 340 wherein each frame mounting units comprises at least one frame connector slot 402 along at least one or more frame edge. Most preferably, each frame edge comprises at least two frame connector slots 402, for example shown and described in further detail in as FIG. 10.

As shown in FIG. 9B, optionally and preferably, the frame 340 may comprise at least one and more preferably a plurality of vertical support structures 405 spanning the length of the frame. Most preferably, frame 401 further comprises at least one and more preferably a plurality of horizontal support structures 403 for accepting the mediating member 206 about at least two or more connectors 206*a-c*, as previously described in FIGS. 3-4. Most preferably horizontal support structure 403 is disposed on one face of the frame. Optionally horizontal support structure 403 comprises a plurality of rack connector slots 406, 406*a*, 406*b* provided for connection to mediating member 206 over connector 206*a*, 206*b* and optionally and preferably over connector 206*c*.

Optionally support structure 403 may be provided in the form of panel 1501 or a portion thereof for example panel medial portion coupling member 1504, therein optionally and preferably allowing for associating frame mounting member 340 with at least one or more holding assembly 1510.

Figure 9D:
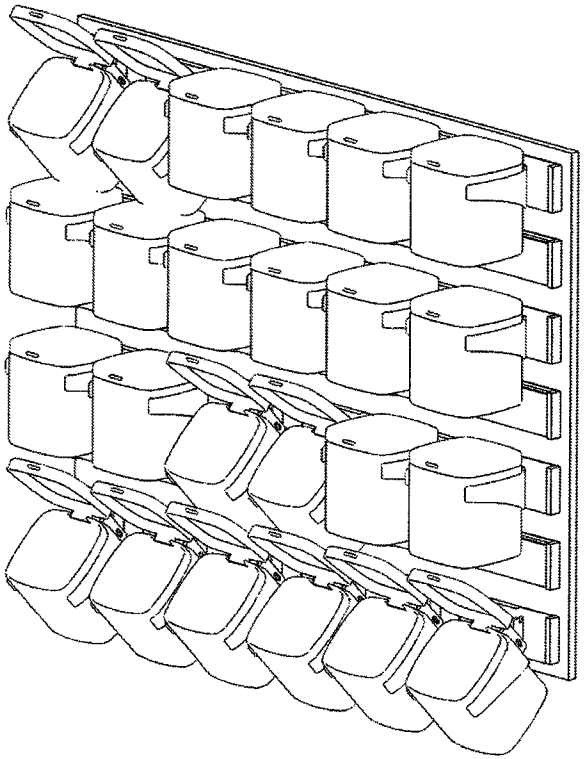
Figure 9C:
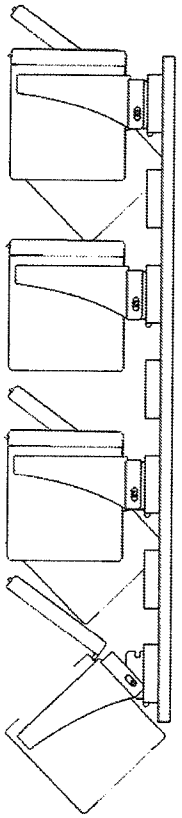

FIGS. 9C-D show a side view and perspective view of frame mounting member 340 associated with a plurality of container 100-106 about holding assembly 201,1510 where some containers are upright, substantially parallel with frame 340 while others are at an angle relative to the mounting member 340 and/or surface.

Figure 10B:
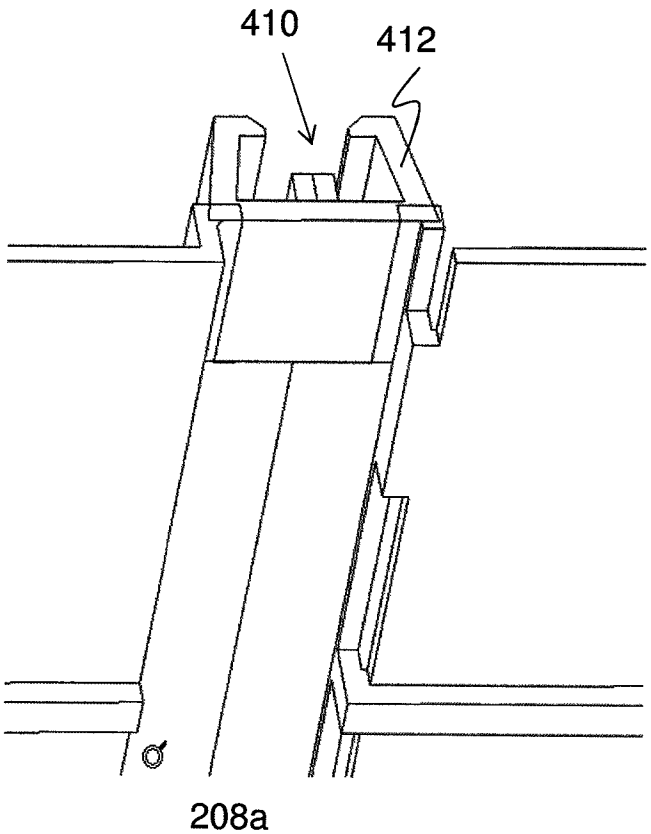
FIG. 10A-E are schematic diagrams of optional coupling mechanisms provided for an optional frame based mounting unit of FIG. 9 according to an optional embodiment of the present invention.
Figure 10A:
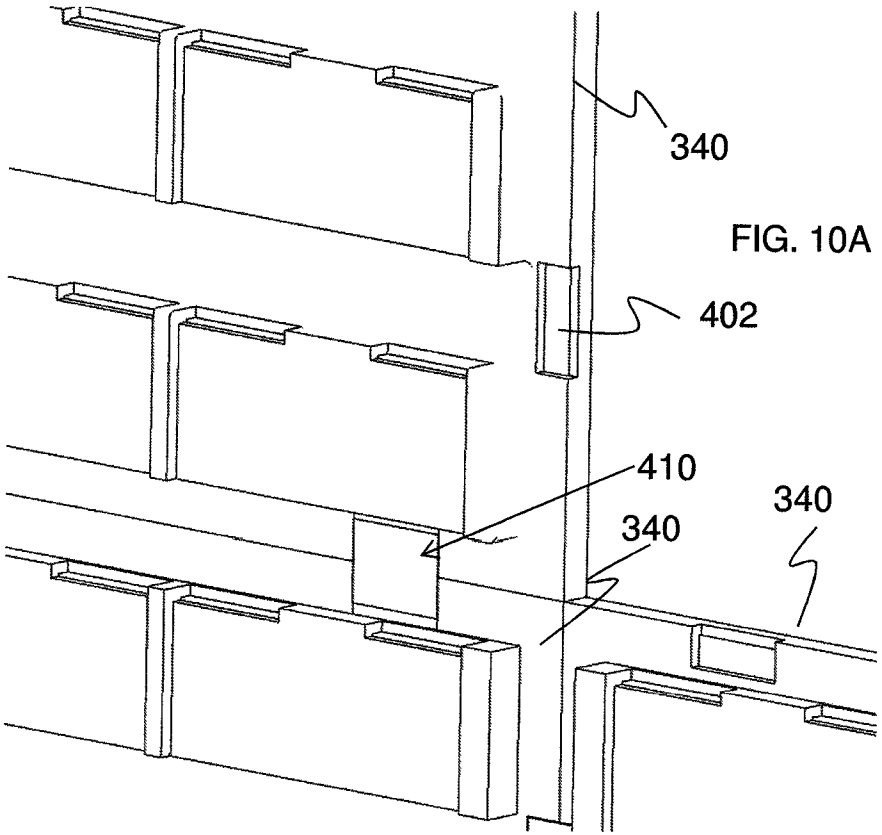
Figure 10E:
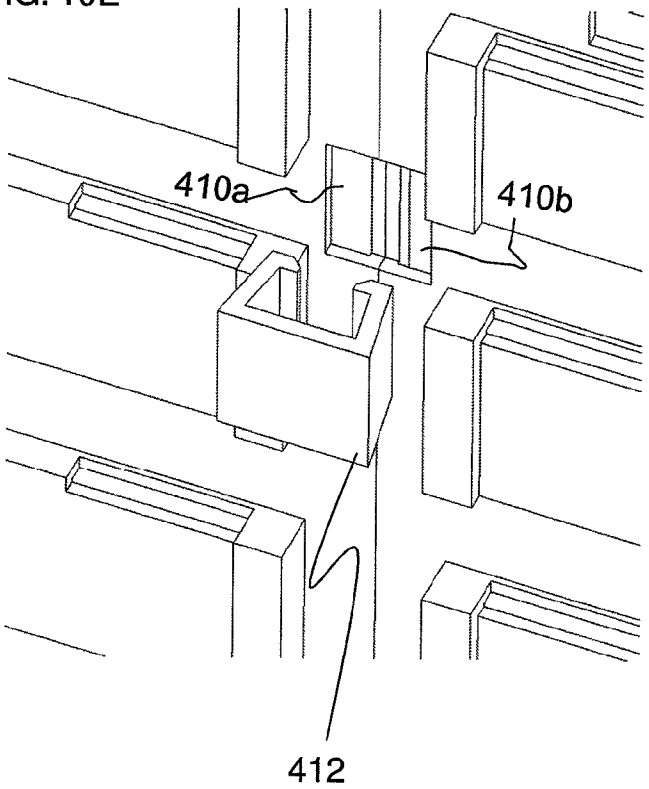
Figure 10C:
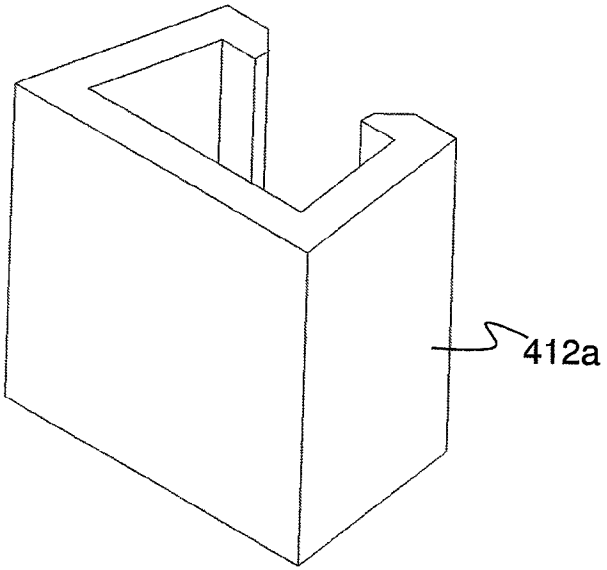
Figure 10D:
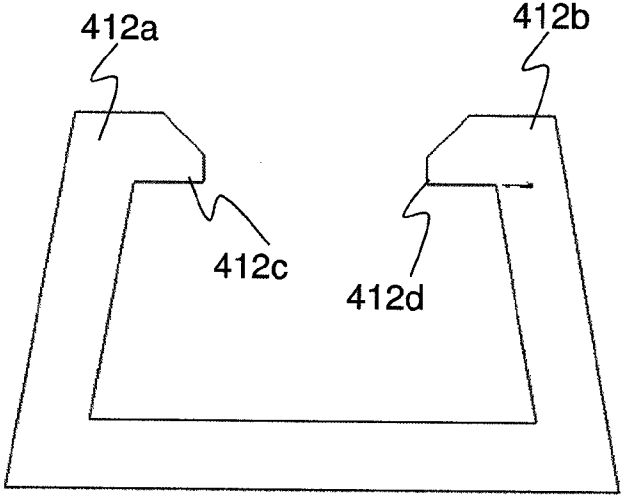

FIG. 10A-E provide close up view of the modular frame system 401,400 as described above with a zoom in of the intersection 410 between two or more adjacent frames 340, about corresponding connector slot 402 that are coupled to produce the storage and organization system as shown in FIG. 9A. FIG. 10E provides a further depiction of frame intersection 410 with a coupling "C" shaped coupler 412 over the intersection 410 used to couple a plurality of frames 340. Variable close up views of "C" shaped coupling member 412 are provided by FIGS. 10C-E. FIG. 10D shows a close up view of clasp 412 comprising a left arm 412*a* having a protruding end 412*c* and right arm 412*b* having protruding end 412*d*. Connector 412 couples a plurality of frames 340 over intersection 410, formed by adjacent connector slots 402 by snapping into right recess 410*a* and left recess 410*b* formed when placing a first frame 340 adjacent to a second frame 340 about corresponding connector slot 402. Optionally and preferably right arm 412*b* fits into recess 410*b* wherein protruding end 412*d* snaps onto backing 401*b* to clamp it into place and left arm 412*a* fits into recess 410*a* wherein protruding end 412*c* snaps onto backing 401*a*. Most preferably protruding end 412*c* and 412*d* snap over 401*b* and 401*a* therein forming a secure coupling for two adjacent frames 340.

FIGS. 11-13 show an optional embodiment of the present invention providing for a mobile container organization system, in the form of a case and/or briefcase 500 comprising a carrying handle 502 is provided with at least one or more mounting members, for example including but not limited to frame mounting member 340, and/or panel medial portion coupling member 1504, as previously described.

Figure 11B:
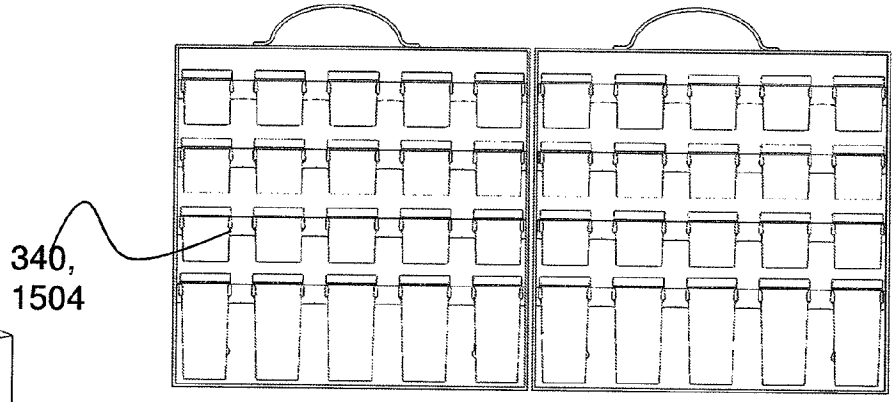
FIG. 11A-C are schematic diagrams of an optional embodiment of the present invention for a carrying case comprising the holding assembly according to an optional embodiment of the present invention.
Figure 11C:
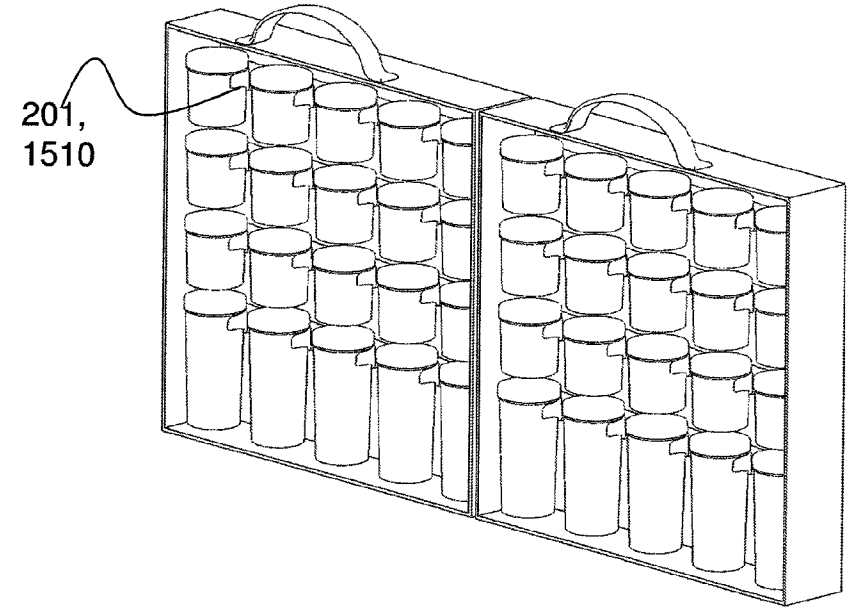
Figure 11A:
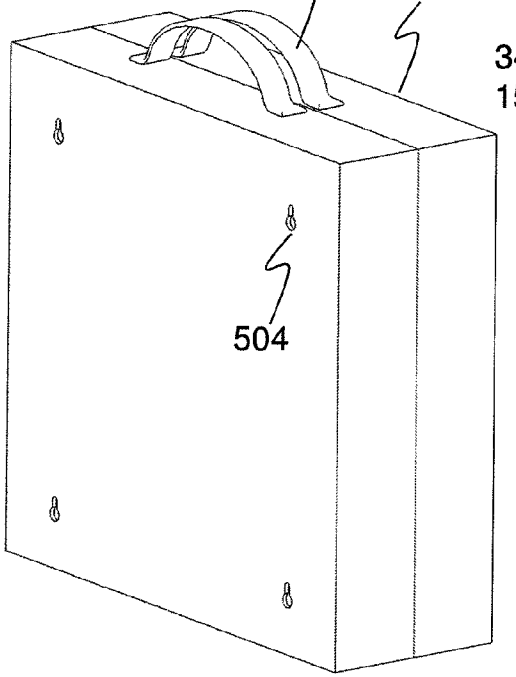

FIG. 11A depicts how mobile system 500 may be wall mounted using at least one or more mounting sockets 504, for example in the form of a keyhole mounting socket as shown. Most preferably the case may be carried in a comfortable manner utilizing handle 502.

FIG. 11B-C show different perspective views of case 500 in an open configuration revealing a plurality of containers organized within the lumen of case 500, and where the containers are held in position about optional holding assembly 201,1510 that are associated with an optional mounting member 340, 1504 disposed within the lumen of case 500. Optionally and preferably holding assembly 201, 1510 may be tilted and/or angled to improve accessibility for a user.

FIG. 12A-C shows an optional carrying case 500 adapted for receiving holding assembly 1510 about mounting member 1504 as previously described. FIG. 12A shows, how optionally and preferably containers 100 may be positioned in at least two positions relative to the mounting surface case 500 in both the open or closed, for example including an upright positions that is substantially parallel to the surface of case 500, as shown for example containers 100*a,b*, and a tilted/angled positions, for example containers 100*c,d*, as shown at about 45 degrees to the case 500. Optionally and preferably at either tilted or upright position container 100 may be provided in either the open configuration 100*b,d* or closed configuration 100*a,c*, as shown.

FIG. 13A-D provides alternative mobile organization system 600 in the form of a case comprising a carrying handle 602 according to an optional embodiment of the present invention wherein a plurality of modular frame type mounting members 340, or mounting member 1504 disposed about a mounting surface, may be loaded with holding assembly 201, 1510 carrying wherein containers 100-106 are stored and made mobile. Most preferably access to the container may be readily access through at least one or more opening 604 or 606. Optionally mounting member 340, 1504 disposed about an optional mounting surface may be moved through opening 604 and/or 606 by sliding.

Figure 14B:
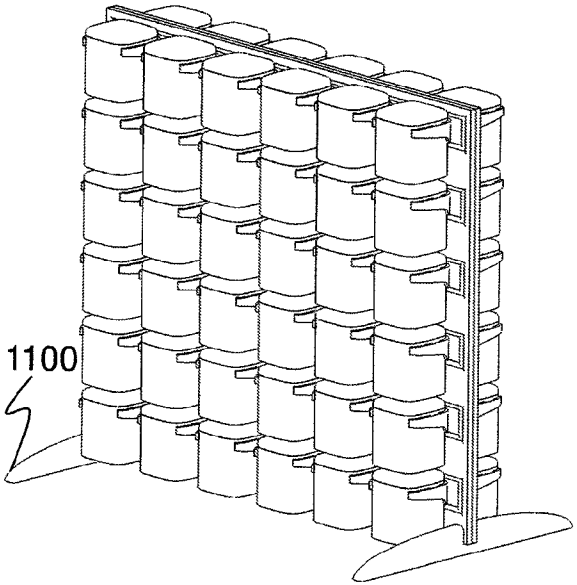
FIG. 14A-C are schematic diagrams of an optional frame modular mounting unit disposed about a base, according to an optional embodiment of the present invention.
Figure 14A:
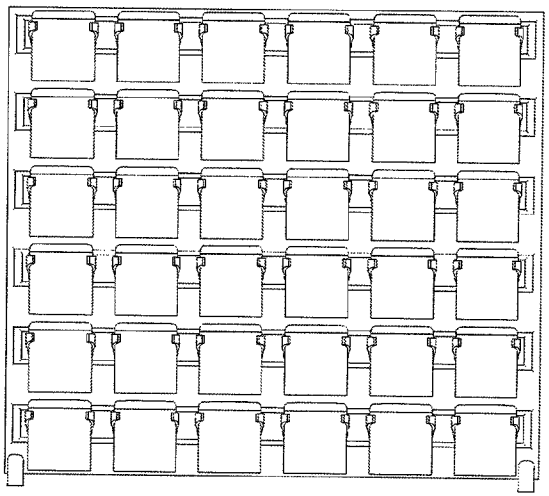
Figure 14C:
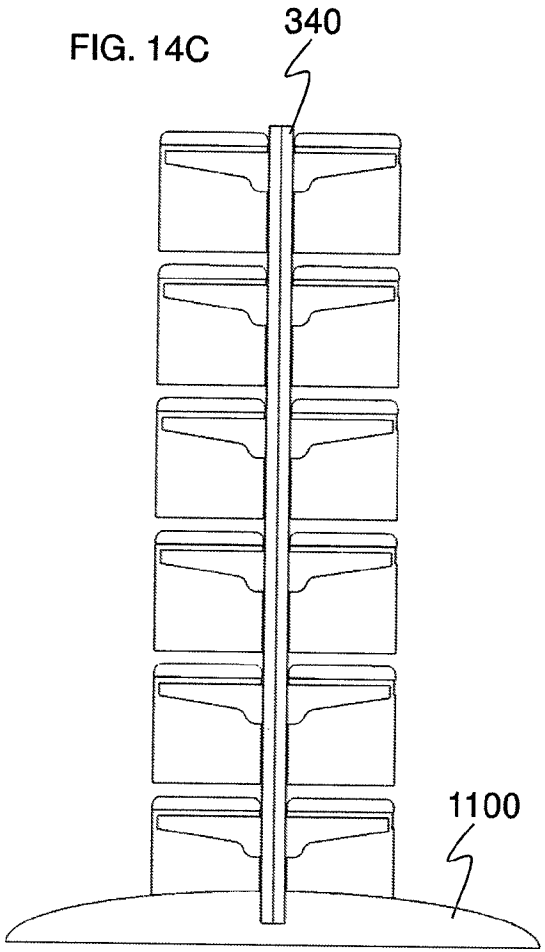

FIG. 14A-C shows an optional embodiment according to the present invention for an organizational system and apparatus wherein frame mounting member 340 or mounting member 1504 disposed about a mounting surface are associated with a base 1100. Optionally and preferably at least two frames 340 may be associated back to back with base 1100 provided a two sided storage and organization apparatus.

Figure 15A:
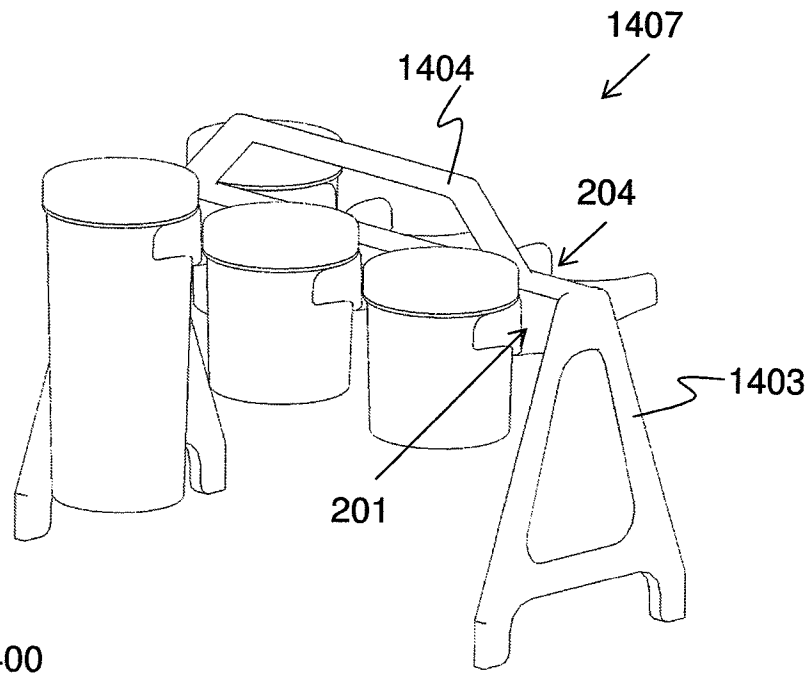
FIG. 15A-B are schematic diagrams of an optional hand held, carrying device container organization system comprising a container holder assembly, according to an optional embodiment of the present.
Figure 15B:
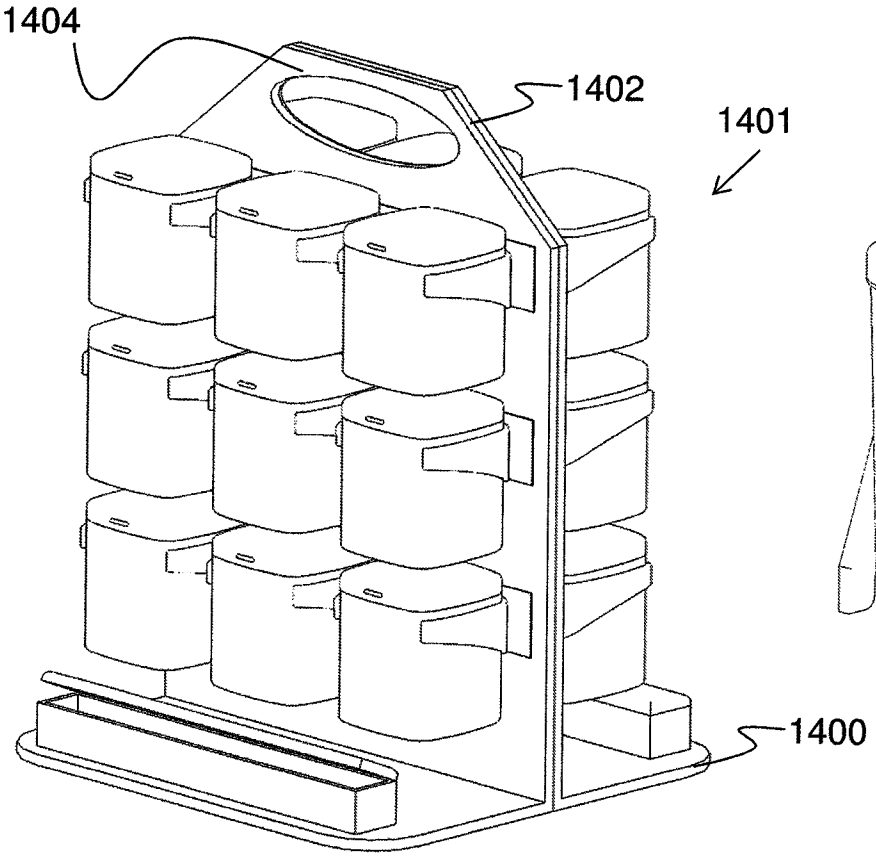

FIGS. 15A-B provide a depiction of a further optional embodiment according to the present invention for a hand held mobile container organization system 1401 and 1407. Most preferably system 1401 comprises a base 1400 having at least one mounting member 1402 comprising a handle 1404 and associated with optional holding member assembly 201, 1510. Optionally mounting member 1402 may be a customized form of frame mounting member 340 provided for associated with a holding assembly 201 via mediating member 206, for example mounting member may be adapted to include handle 1404 and base 1400. Optionally mounting member 1402 may be realized by way of coupling at least one and more preferably a plurality of rail 1504 mounting members about a mounting surface, provided to associate with a holding assembly 1510 via mediating member 1514, as previously described.

System 1401 is optionally carried by a user with handle 1404 and may be utilized as an accessory to a wall mounted container organizational systems, for example as shown in FIGS. 9 and 11-14.

FIG. 15B provides a depiction of system 1407 of a further optional embodiment according to the present invention, which may optionally operate as a "stand alone" unit, or as an accessory unit to a larger container organizing system. Most preferably system 1407 comprises a base and mounting support 1403 comprising handle 1404. Optionally and preferably mounting support 1403 comprises at least one optional mounting member, for example rail 1504 or horizontal support 403, onto which a plurality of container holding assembly 201,1510, may be associated.

FIG. 16 shows an optional tool carrying and organization device 2000 shown comprising a plurality of holding assembly 1510 according to an optional embodiment of the present invention. FIG. 16 shows an optional tool carrying device 2000 in the form of a bucket having a carrying handle 2002, the bucket shown having a "H-shaped" cross-section, however the tool carrying device according to the present invention is not limited to such an "H-shaped" configuration. Most preferably tool carrying device 2000 defines an open space 2010 providing for carrying tools therein.

Optionally tool carrying device 2000 may be realized in the form of a tool case, tool box or the like. Optionally tool carrying device 2000 may be provided with a lid and/or cover, to close open space 2010.

Most preferably organization device 2000 comprises at least one or more holding assembly, for example including but not limited to holding assembly 1510 as previously described FIG. 5-8. Optionally, holding assembly 1510 may be disposed about at least one or more external surface. Optionally holding assembly 1510 may be associated with device 2000 wherein its protrudes from the plane of the external surface. Optionally and preferably holding assembly 1510 may be disposed within an indentation about an external surface of device 2000. For example, an indentation may be provided in the form of an indentation 2008 disposed about an external surface of device 2000, as shown, providing the "H-shape" configuration of device 2000. Most preferably at least one or more holding assembly 1510 may be disposed within the indentation 2008. Optionally device 2000 may be fit with at least one or more indentation about a surface of device 2000. Optionally device 2000 may be configured to have a at least two or more indentation about a single surface of device 2000. Optionally at least one or more surfaces of device 2000 may be fit with at least one or more indentation 2008.

Optionally organization device 2000 may further comprise at least one or more tool rack 2012 about at least one or more surface, for example as shown. Optionally tool rack 2012 may be configured to hold any tool for example including but not limited to screw drivers, pliers, keys, wrench, Allen keys, power tools, hammers or the like tools. Optionally tool rack 2012 may be configured to associated and/or disassociate from device 2000. Optionally device 2000 may be modified and/or customized for different uses such that it is fit with different type of tool racks 2012 customized for different uses, for example a tool rack 2012 may be customized for a different uses for example a first tool rack 2012 may be customized for a plumber while a second tool rack 2012 may be customized for an electrician, therein forming a specialized carrying tool organizational device 2000.

While the invention has been described with respect to a limited number of embodiment, it is to be realized that the optimum dimensional relationships for the part of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not described to limit the invention to the exact construction and operation shown and described and accordingly, all suitable modifications and equivalents may be resorted to, falling within the scope of the invention.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

Further modifications of the invention will also occur to persons skilled in the art and all such are deemed to fall within the spirit and scope of the invention as defined by the appended claims.

While the invention has been described with respect to a limited number of embodiments, it will be appreciated that many variations, modifications and other applications of the invention may be made.

What is claimed is:

1. A container holding assembly for positioning a container and rotating the container between at least two positions relative to a mounting surface, the container assembly comprising:

a) at least one container holder for holding said container, said holder having at least two extensions including two flanking arms and a lower surface retainer defining an anterior opening for receiving said container; wherein, when in use, the container is configured to be wedged between the flanking arms;

b) said container holder comprising a backing member extending between the flanking arms and the lower surface retainer, wherein said backing member comprises a positioning recess and a cavity formed in a rear of the backing member, wherein said positioning recess is a bifurcated recess;

c) a mediating member having at least one peg protruding from the mediating member, wherein the mediating member has a first end that is configured to be inserted within the cavity of said backing member, wherein the least one peg is configured to be inserted within and slide relative to the bifurcated recess of the backing member in order to rotate the container holder relative to said mounting surface about said at least two positions; and wherein said mediating member is provided for mounting said holder onto said mounting surface or a mounting member.

2. The container holding assembly of claim 1 wherein said at least two positions relative to a mounting surface are selected from the group consisting of substantially parallel to said mounting surface, about 45 degrees, about 30 degrees, about 60 degrees and about 180 degrees to said mounting surface.

3. The container holding assembly of claim 1 wherein said mediating member is configured to receive a single holder.

4. The container holding assembly of claim 1 wherein said container is selected from the group consisting of a jar, jar with an integrated lid, container with an integrated hinged lid, open container, container with a seal.

5. The container holding assembly of claim 1 wherein said mounting member is provided in the form of a mounting panel provided for receiving or interfacing with at least one of said mediating member.

6. The container organization system of claim 1 wherein said mounting member may be coupled to a mounting surface selected from the group consisting of a vertical surface, a wall, a base, an internal lumen of a carrying case, tool case, tool bucket, tool box.

7. The container organization system of claim 1 wherein said mounting surface is a mobile carrier in the form of a briefcase with at least one opening for gaining access to said container.

8. The container organization system of claim 7 wherein said mobile carrier comprises at least two openings to gain access to multiple containers.

9. The container organization system of claim 7 wherein said mobile carrier further comprises at least two mounting sockets disposed on an external surface thereof.

10. A container organization system provided in the form of a tool bucket defining an open lumen for receiving optional tools having a carrying handle and at least one container holding assembly affixed to a surface of said tool bucket, the container holding assembly including:

a) at least one container holder for holding said container, said holder having at least two extensions including two flanking arms and a lower surface retainer defining an anterior opening for receiving said container; wherein, when in use, the container is configured to be wedged between the flanking arms;

b) said container holder comprising a backing member extending between the flanking arms and the lower surface retainer, wherein said backing member comprises a positioning recess and a cavity formed in a rear of the backing member, wherein said positioning recess is a bifurcated recess;

c) a mediating member having at least one peg protruding from the mediating member, wherein the mediating member has a first end that is configured to be inserted within the cavity of said backing member, wherein the least one peg is configured to be inserted within and slide relative to the bifurcated recess of the backing member in order to rotate the container holder relative to said tool bucket about said at least two positions; and wherein said mediating member is provided for mounting said holder onto a surface of said tool bucket.

11. The container organization system of claim 10 wherein said at least one holding assembly is disposed about a surface of said tool bucket selected from an external surface and an internal surface.

12. The container organization system of claim 11 wherein said tool bucket includes at least one holding assembly configured to protrude from said external surface disposed about an indentation about at least one external surface.

13. The container organization system of claim 12 wherein said external surface further comprises at least one or more tool racks.

14. The container organization system of claim 13 wherein said tool rack is configured to removably attached to the external surface of the tool bucket.

15. The container holding assembly of claim 1 wherein said at least one container assembly provides for positioning said container and toggling between at least three positions relative the mounting surface, the positioning selected from the group consisting of substantially parallel to said mounting surface, about 45 degrees, about 30 degrees, about 60 degrees, and about 180 degrees to said mounting surface.

16. The container organization assembly of claim 10 wherein the surface of said bucket is configured to have at least two indentations for receiving the at least one container holding assembly.

17. The container holding assembly of claim 1 wherein said assembly is affixed to the mounting surface selected from the group consisting of a vertical surface, a wall, a base, an internal lumen of a carrying case, tool case, tool bucket, and tool box.

18. The container holding assembly of claim 1 wherein said mounting member is provided in the form of a panel.

* * * * *